US007216948B2

(12) United States Patent
Matsuzaki et al.

(10) Patent No.: US 7,216,948 B2
(45) Date of Patent: May 15, 2007

(54) IMAGE FORMING APPARATUS

(75) Inventors: Yoshiki Matsuzaki, Ebina (JP); Kozo Tagawa, Ebina (JP); Ryo Ando, Ebina (JP); Takeshi Kato, Ebina (JP); Tsutomu Udaka, Ebina (JP); Toshiyuki Kazama, Ebina (JP); Osamu Goto, Ebina (JP); Kenichi Kawauchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 10/902,060

(22) Filed: Jul. 30, 2004

(65) Prior Publication Data

US 2005/0062784 A1 Mar. 24, 2005

(30) Foreign Application Priority Data

Aug. 7, 2003 (JP) ..... 2003-288510

(51) Int. Cl.
*B41J 29/393* (2006.01)

(52) U.S. Cl. ..... 347/14; 347/19

(58) Field of Classification Search ..... 347/19, 347/14

See application file for complete search history.

(56) References Cited

U.S. PATENT DOCUMENTS 5,581,284 A * 12/1996 Hermanson ..... 347/43
6,412,903 B1 * 7/2002 Lee et al. ..... 347/19
6,637,854 B2 * 10/2003 Serra et al. ..... 347/19

FOREIGN PATENT DOCUMENTS

JP A 4-193542 7/1992

* cited by examiner

*Primary Examiner*—Lamson Nguyen
(74) *Attorney, Agent, or Firm*—Oliff & Berridge, PLC

(57) ABSTRACT

An image forming apparatus has: a recording head having plural unit recording heads divided in a direction orthogonal to a moving direction of a recording medium; a detecting section detecting at least offset of an image recorded by a vicinity of an end portion, in the direction orthogonal to the moving direction of the recording medium, of the plural unit recording heads; and a correcting section correcting recording offset of the recording head on the basis of results of detection of the detecting section.

22 Claims, 21 Drawing Sheets

RECORDING HEAD POSITIONS

IMAGE OUTPUT TIMINGS AND PRINTING REGIONS

IMAGE POSITIONS

IMAGE POSITIONS AFTER CORRECTION

FIG. 18A

| SENSOR | K OFFSET (UNIT RECORDING HEAD NEAR K0-1 IS REFERENCE) | Y OFFSET A (K IS REFERENCE) | Y OFFSET B (K IS REFERENCE) |
|---|---|---|---|
| s11 | E - K11 | E - YK11A | E - YK11B |
| s12 | E - K12 | E - YK12A | E - YK12B |
| s22 | E - K22 | E - YK22A | E - YK22B |
| s23 | E - K23 | E - YK23A | E - YK23B |
| s33 | E - K33 | E - YK33A | E - YK33B |
| s34 | E - K34 | E - YK34A | E - YK34B |
| s44 | E - K44 | E - YK44A | E - YK44B |
| s45 | E - K45 | E - YK45A | E - YK45B |
| s55 | E - K55 | E - YK55A | E - YK55B |
| s56 | E - K56 | E - YK56A | E - YK56B |
| s66 | E - K66 | E - YK66A | E - YK66B |

FIG. 18B

| K0-1 IS REFERENCE | | |
|---|---|---|
| K OFFSET | Y OFFSET A | Y OFFSET B |
| E - K111 | E - YK111A | E - YK111B |
| E - K112 | E - YK112A | E - YK112B |
| E - K122 | E - YK122A | E - YK122B |
| E - K123 | E - YK123A | E - YK123B |
| E - K133 | E - YK133A | E - YK133B |
| E - K134 | E - YK134A | E - YK134B |
| E - K144 | E - YK144A | E - YK144B |
| E - K145 | E - YK145A | E - YK145B |
| E - K155 | E - YK155A | E - YK155B |
| E - K156 | E - YK156A | E - YK156B |
| E - K166 | E - YK166A | E - YK166B |

FIG. 18C

| SKEW OFFSET Y | |
|---|---|
| — | SE-YK-11 |
| SE-YK-02 | SE-YK-12 |
| SE-YK-03 | SE-YK-13 |
| SE-YK-04 | SE-YK-14 |
| SE-YK-05 | SE-YK-15 |
| SE-YK-06 | — |

FIG. 19

| UNIT RECORDING HEAD | CORRECTION AMOUNT | | |
|---|---|---|---|
| | K LENGTHWISE DIRECTION | Y | |
| | | LENGTHWISE DIRECTION | SKEW |
| FIRST IN GROUP 0 | REFERENCE | - (E-YK111A) | - |
| FIRST IN GROUP 1 | - (E-K111) | - (E-YK111B) | - (SE-YK-11) |
| SECOND IN GROUP 0 | - (E-K112) | - (E-YK112B) | - (SE-YK-02) |
| SECOND IN GROUP 1 | - (E-K122) | - (E-YK122B) | - (SE-YK-12) |
| THIRD IN GROUP 0 | - (E-K123) | - (E-YK123B) | - (SE-YK-03) |
| THIRD IN GROUP 1 | - (E-K133) | - (E-YK133B) | - (SE-YK-13) |
| FOURTH IN GROUP 0 | - (E-K134) | - (E-YK134B) | - (SE-YK-04) |
| FOURTH IN GROUP 1 | - (E-K144) | - (E-YK144B) | - (SE-YK-14) |
| FIFTH IN GROUP 0 | - (E-K145) | - (E-YK145B) | - (SE-YK-05) |
| FIFTH IN GROUP 1 | - (E-K155) | - (E-YK155B) | - (SE-YK-15) |
| SIXTH IN GROUP 0 | - (E-K156) | - (E-YK156B) | - (SE-YK-06) |
| SIXTH IN GROUP 1 | - (E-K166) | - (E-YK166B) | - |

IMAGE FORMING APPARATUS

CROSS-REFERENCE TO RELATED APPLICATION

This application claims priority under 35 USC 119 from Japanese Patent Application No. 2003-288510, the disclosure of which is incorporated by reference herein.

BACKGROUND OF THE INVENTION

1. Field of the Invention

The present invention relates to an image forming apparatus, and in particular, to an image forming apparatus having a recording head in which plural unit recording heads are lined-up in a direction orthogonal to a conveying direction of a recording medium.

2. Description of the Related Art

Generally, a recording head which is known in an inkjet system has plural nozzles which discharge ink. Ink is discharged from the nozzles by utilizing the vibration of a piezo element or the heat generated by a heat-generating element or the like. Plural recording heads, which discharge inks of the respective colors of yellow, magenta, cyan, black, and the like, are provided. A color image is formed by recording, in a superposed manner, the respective colors of the recording heads.

However, currently, inkjet recording devices which are mainly becoming popular are those of a recording method called serial scanning which records line-by-line by moving a recording head reciprocally while conveying a recording sheet. This method is compact and inexpensive, but has the disadvantage that the recording head must be scanned plural times in order to record an image over the entire recording medium and the recording speed is slow. In order to improve the recording speed, the number of scans must be reduced, and the recording head must be made to be long. The technique which has pushed this to the limit is a non-scanning recording method which records over a length which is substantially the same as the recording width. This recording method is an inkjet recording device having a recording head which corresponds to the width of the recording medium and at which a large number of nozzles are lined-up along a length which is substantially the same as the width of the recording medium. Recording is carried out by moving the recording medium with respect to the recording head which is fixed.

In addition thereto, there has also been proposed, as such a non-scanning recording method, a structure in which plural recording heads such as those used in serial scanning are lined-up in a staggered manner or the like along the width of the recording medium as unit recording heads. The scanning speed can also be improved with this inkjet recording device.

In this way, inkjet recording devices which, while continuously conveying a recording medium, record by non-scanning type recording heads which correspond to the width of the recording medium, have been proposed in order to improve the recording speed and handle application to office use.

On the other hand, although a color image is formed by recording, in a superposed manner, the respective colors of plural recording heads as described above, if offset of the recording positions of the recording heads arises, color offset arises and the image quality deteriorates. Thus, techniques such as those disclosed in Japanese Patent Application Laid-Open (JP-A) No. 04-193542 have been proposed.

In the technique disclosed in JP-A No. 04-193542, in an inkjet recording device having a full-line-type recording head having plural discharge openings over the entire width of the recording region of a recording medium, subscan offset caused by inclining of the nozzles of the respective colors, and color offset arising due to warping of the nozzles, are detected by reading a pattern on a sheet, and the color offset is corrected by changing the writing timing.

As in the invention disclosed in JP-A No. 04-193542, in an image forming device having a full-line-type recording head equipped with plural discharge openings over the entire width of the recording region of the recording medium, the color offset can be corrected merely by changing the writing timing as described above.

However, in a recording head equipped with plural unit recording heads, there is the problem that, due to offset in the assembled positions of the respective unit recording heads or the like, the offset of the recording positions cannot be corrected merely by changing the writing timing.

SUMMARY OF THE INVENTION

The present invention is developed in consideration of the aforementioned, and provides an image forming apparatus which can prevent recording offset between respective unit recording heads in a recording head having plural unit recording heads.

An image forming apparatus of a first aspect of the present invention has: a recording head having plural unit recording heads divided in a direction orthogonal to a moving direction of a recording medium; a detecting section detecting at least offset of an image recorded by a vicinity of an end portion, in the direction orthogonal to the moving direction of the recording medium, of the plural unit recording heads; and a correcting section correcting recording offset of the recording head on the basis of results of detection of the detecting section.

In accordance with the image forming apparatus of the first aspect of the present invention, the recording head is structured by being divided into plural unit recording heads in the direction orthogonal to the moving direction of the recording medium. Namely, the recording head can carry out recording in the direction orthogonal to the moving direction of the recording medium by the plural unit recording heads. For example, a recording head in which the plural unit recording heads are lined-up in a staggered form along the transverse direction of the recording medium, can be used as the recording head.

The detecting section detects at least the offsets of the images recorded between the plural unit recording heads. For example, the offsets of the images recorded between the unit recording heads can be detected by recording predetermined test patterns onto a recording medium or the like at predetermined intervals by using regions between the respective unit recording heads, i.e., vicinities of the both ends of the respective unit recording heads, and by detecting these test patterns.

Then, on the basis of the results of detection of the detecting section, the correcting section corrects the recording offset of the recording head. Namely, from the results of detection of the detecting section, the correcting section can correct the recording offsets among the respective unit recording heads. Accordingly, at a recording head having plural unit recording heads, recording offset between the respective unit recording heads can be prevented.

An image forming apparatus of a second aspect of the present invention has: a recording head having plural unit recording heads divided in a direction orthogonal to a moving direction of a recording medium; a detecting section detecting at least offset of an image recorded by a vicinity of an end portion, in the direction orthogonal to the moving direction of the recording medium, of the plural unit recording heads; and a correcting section correcting recording offset of the recording head on the basis of results of detection of the detecting section, wherein the recording head has plural blocks, with each block being structured by a predetermined number of the unit recording heads, which can record images of plural colors and which are lined-up along the moving direction of the recording medium, and the plural blocks are lined-up in a staggered form along the direction orthogonal to the moving direction of the recording medium.

As described above, in accordance with the present invention, a detecting section, which detects at least offset of images recorded between plural unit recording heads structuring a recording head, and a correcting section correcting the recording offset of the recording head on the basis of results of detection of the detecting section, are provided. Therefore, the present invention has the effect that, in a recording head having plural unit recording heads, it is possible to prevent recording offset among the respective unit recording heads.

BRIEF DESCRIPTION OF THE DRAWINGS

Preferred embodiments of the present invention will be described in detail based on the following figures, wherein:

FIGS. 18A through 18C are tables showing results of calculation of offset amounts of the unit recording heads;

FIG. 19 is a table showing calculated correction amounts;

DETAILED DESCRIPTION OF THE INVENTION

Hereinafter, examples of embodiments of the present invention will be described in detail with reference to the drawings.

First, the basic structure of a recording head of an image forming apparatus according to an embodiment of the present invention will be described.

Figure 1:
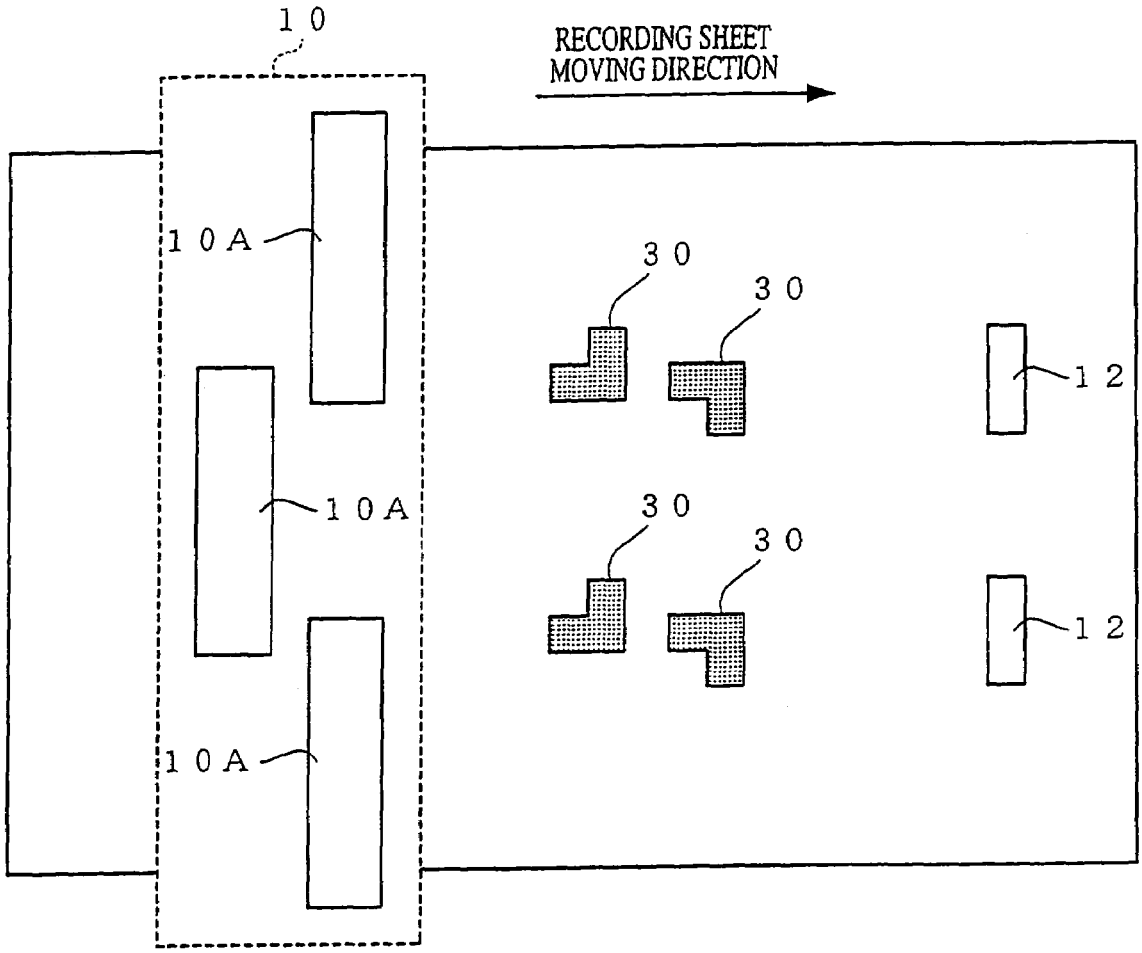
FIG. 1 is a drawing showing the basic structure of a recording head in an image forming apparatus according to an embodiment of the present invention.

FIG. 1 is a drawing showing the basic structure of the recording head in the image forming apparatus according to the embodiment of the present invention.

The image forming apparatus has a recording head 10 extending over substantially the entire width of a recording sheet. The recording head 10 is structured by plural unit recording heads 10A which are structured by plural nozzles, which discharge ink, being lined-up. In other words, the recording head 10 is structured so as to be divided into the plural unit recording heads 10A.

In further detail, at the recording head 10, the plural unit recording heads 10A are disposed along the entire width of the recording sheet in a staggered arrangement of being offset both in the conveying direction of the recording sheet and the transverse direction of the recording sheet (the direction orthogonal to the recording sheet conveying direction). The adjacent unit recording heads 10A are disposed so as to have regions which overlap one another in the transverse direction of the recording sheet (overlapping regions). Note that a structure in which the overlapping regions are not provided may be used.

Sensors 12 for detecting positional offset due to the assembly precision or the like of the respective unit recording heads 10A are provided at the image forming apparatus. The sensors 12 are disposed so as to correspond to regions between the unit recording heads 10A. In detail, the sensors 12 are provided at least at positions of detecting the images recorded by the nozzles corresponding to the overlapping regions between the respective unit recording heads 10A. CCD sensors or the like may be used as the sensors 12. Further, the sensors 12 may be provided at the recording head 10.

The image forming apparatus records test patterns for correcting the positional offset of the respective unit recording heads 10A. By detecting the test patterns by the sensors 12, the positional offset of the unit recording heads 10A is corrected.

The recording heads 10 may be provided for each of respective colors so as to discharge inks of the respective colors of, for example, cyan, magenta, yellow and black. A color image can be formed by providing recording heads of the respective colors.

Figure 2:
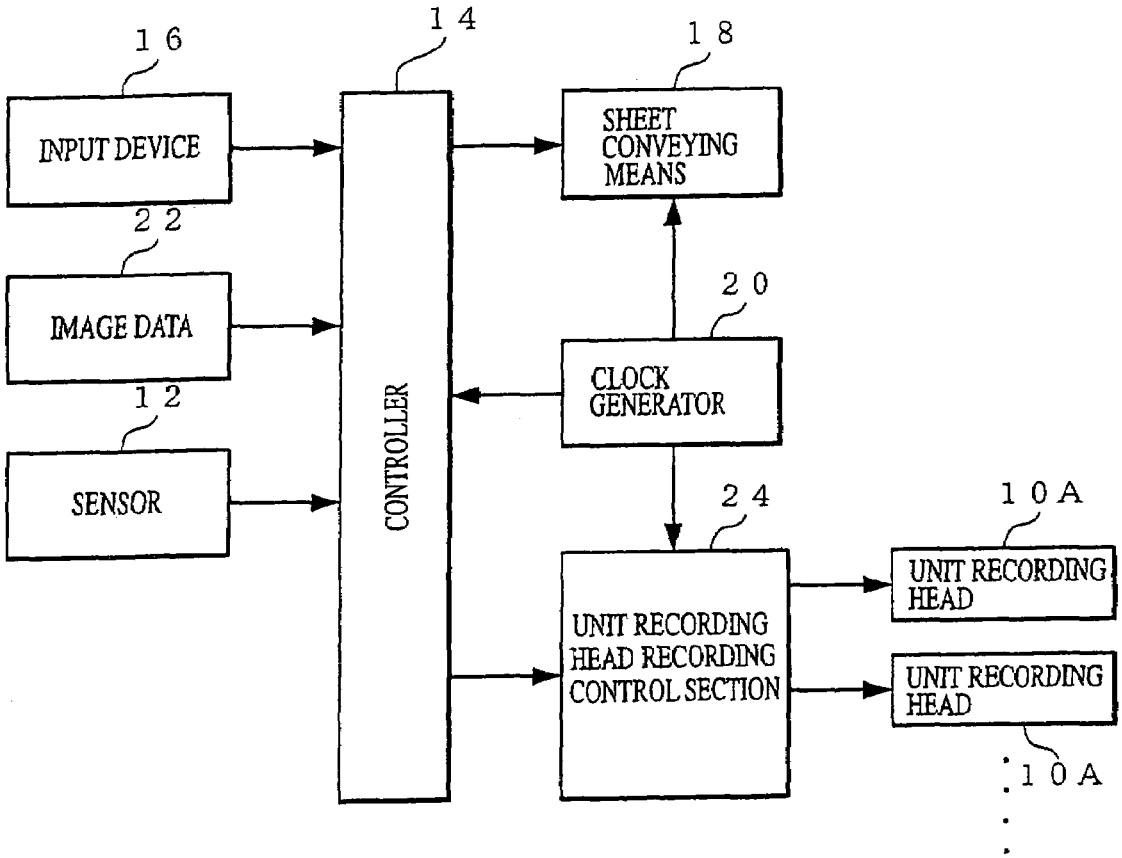
FIG. 2 is a block diagram showing the basic structure of a control system of the image forming apparatus according to the embodiment of the present invention.

FIG. 2 is a block diagram showing the basic structure of the control system of the image forming apparatus.

At the image forming apparatus, the various types of control of the image recording onto a recording sheet are carried out by a controller 14. The controller 14 is structured by a microcomputer equipped with a CPU, a ROM, a RAM, peripheral devices, and the like.

An input device 16 for carrying out various types of settings of the image forming apparatus and various types of instructions such as an instruction to start image recording or the like, a sheet conveying section 18 which conveys the recording sheet, a clock generator 20 which generates a clock for operating the image forming apparatus, a unit recording head recording control section 24 which carries out control for discharging ink from the respective unit recording heads 10A on the basis of image data 22 inputted to the controller 14, and the like are connected to the controller 14. When, for example, the start of image recording is instructed by the input device 16, recording of an image onto a recording sheet is carried out on the basis of the image data 22 inputted from an external device or a computer or the like. Namely, when an image is to be recorded onto a recording sheet, the controller 14 controls the sheet conveying section 18 to convey the recording sheet to the recording head 10, and controls the unit recording head recording control section 24 to record images successively by the unit recording heads 10A. The unit recording head recording control section 24 controls the discharge of ink from the nozzles of the respective unit recording heads 10A, and controls the timing of the discharge of ink from the respective nozzles (the recording timing). An image is thereby recorded onto the recording sheet.

The aforementioned sensors 12 are connected to the controller 14, and the results of detection of the sensors 12 are inputted to the controller 14. On the basis of the results of detection of the sensors 12, the controller 14 corrects the positional offset of the image by controlling the recording timings of the respective unit recording heads 10A, the positions of the nozzles which are used of the respective unit recording heads 10A, and the like.

Here, description will be given of recording position offset in a case in which an image is recorded by the recording head 10 which is structured as described above.

Figure 3:
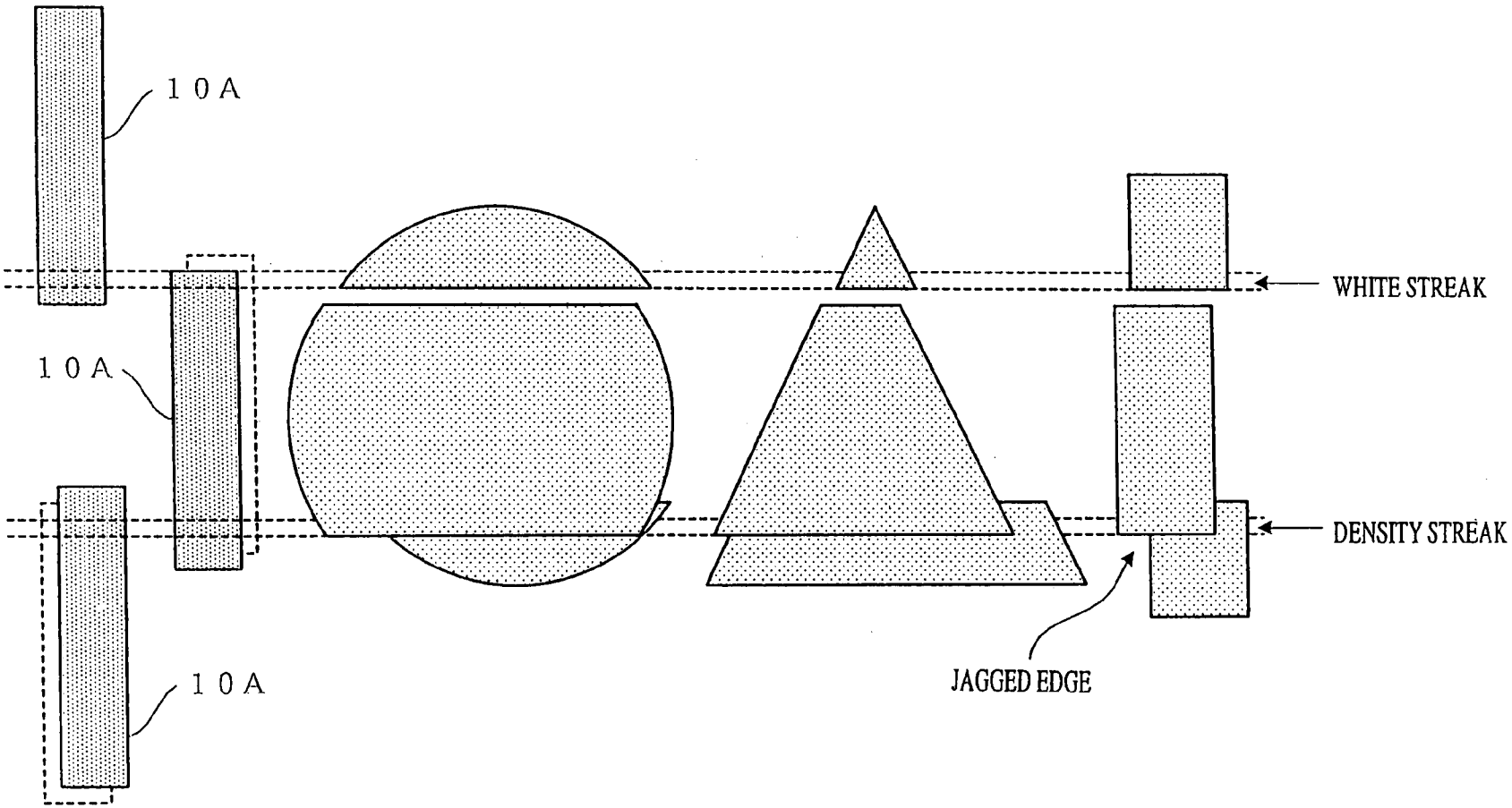
FIG. 3 is a drawing for explaining recording offset of unit recording heads.
Figure 4:
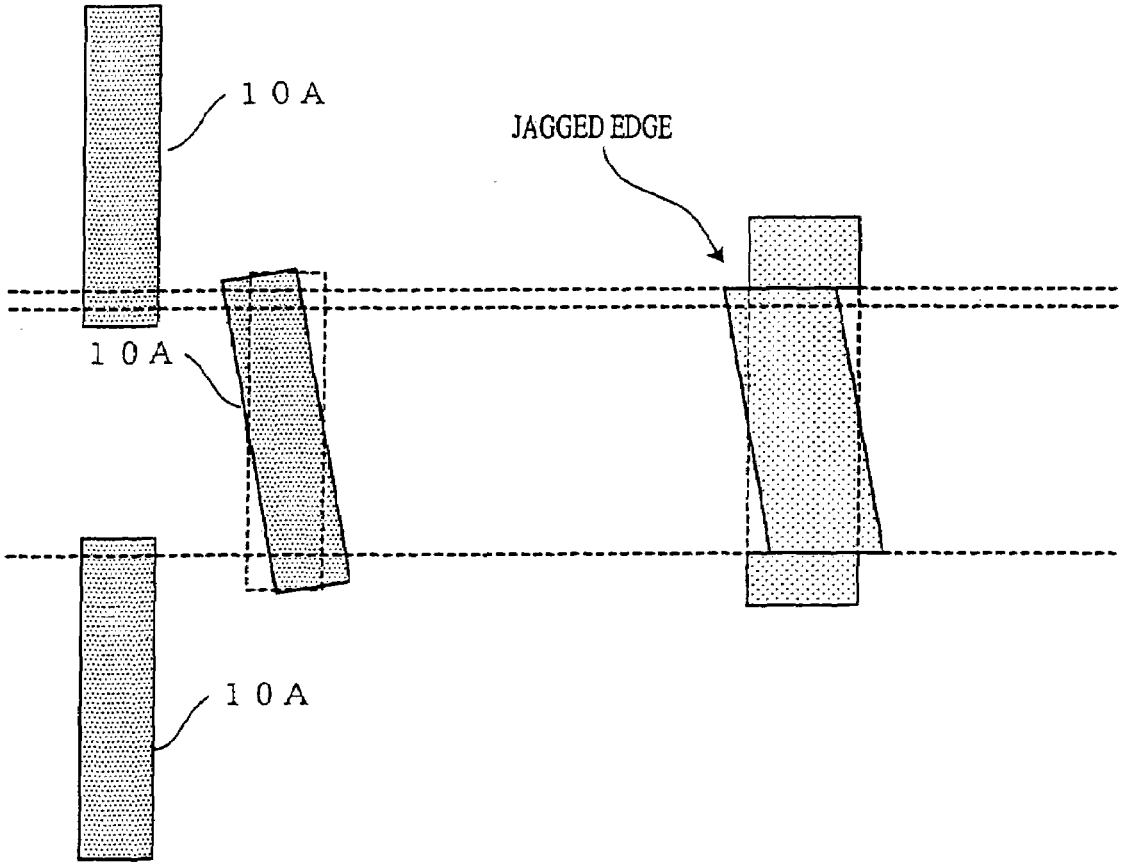
FIG. 4 is a drawing for explaining recording offset due to inclining of the unit recording head.

As described above, the recording head 10 is divided in the direction orthogonal to the recording sheet conveying direction, and is divided in the recording sheet conveying direction. The recording positions are determined with there being errors from the time of manufacturing and assembly, between the unit recording heads 10A structuring the recording head 10. The dashed lines in FIG. 3 show the ideal positions of the unit recording heads 10A, and the solid lines show the positions of the unit recording heads 10A which are mounted with errors. If recording processing is carried out at a given recording timing or by using given image data without considering this error, the recording positions will differ between the respective unit recording heads 10A as shown in FIG. 3, and jagged edges of the image, streaks in density, white streaks caused by gaps in recording, and the like will arise. Further, as shown in FIG. 4, also when the unit recording head 10A is assembled at an incline, in the same way as described above, jagged edges of the image, streaks in density, white streaks caused by gaps in recording, and the like will arise. Moreover, if the recording heads 10 are provided for the respective colors, when the recording heads 10 are assembled with errors at the respective colors, the recording positions will differ at the respective colors, and color offset (hereinafter called "color registration offset") will arise.

Thus, in the image forming apparatus according to the present embodiment, test patterns are recorded, and by detecting the positions of the test patterns, the amounts of offset of the recording positions of the images are detected, and the recording positions are corrected on the basis of the detected positional offset amounts.

Next, description will be given of the detection of recording position offset between the unit recording heads 10A in the image forming apparatus which is structured as described above.

As shown in FIG. 1, L-shaped test patterns 30 are recorded by the respective unit recording heads 10A. The recording positions are positions at the junctures of the unit recording heads 10A, and the test patterns 30 are recorded at predetermined intervals.

The recording positions of the test patterns 30 are detected due to the sensors 12 detecting the recorded test patterns 30. Here, there is no problem provided that the absolute positional offset from the ideal position can be detected. However, due to the mounting accuracy and the detection timing of the sensors 12 and fluctuations in the moving speeds of the test patterns 30 and the like, there are cases in which it is difficult to learn of the absolute position as the errors in precision are large. Thus, by using a predetermined unit recording head 10A as a reference, the relative offset with respect to this unit recording head 10A which is the reference is detected. For example, the times (distances) of lines, which extend in the direction perpendicular to the recording sheet conveying direction, of the reference unit recording head 10A and another unit recording head 10A are detected, and the amount of offset from the ideal interval is used as the offset, in the recording sheet conveying direction, with respect to the reference unit recording head 10A. Further, with respect to the offset in the transverse direction of the recording sheet, similarly, the offset of a line segment extending in the recording sheet conveying direction is detected, and is used as the offset, in the recording sheet transverse direction, with respect to the reference unit recording head 10A.

Note that, also in a case in which the recording heads 10 are provided for the respective colors, similarly, the relative positional offset can be detected by detecting the offset with respect to the unit recording head 10A which is the reference.

Next, correction of the positional offset which is detected as described above will be described.

Figure 5A:
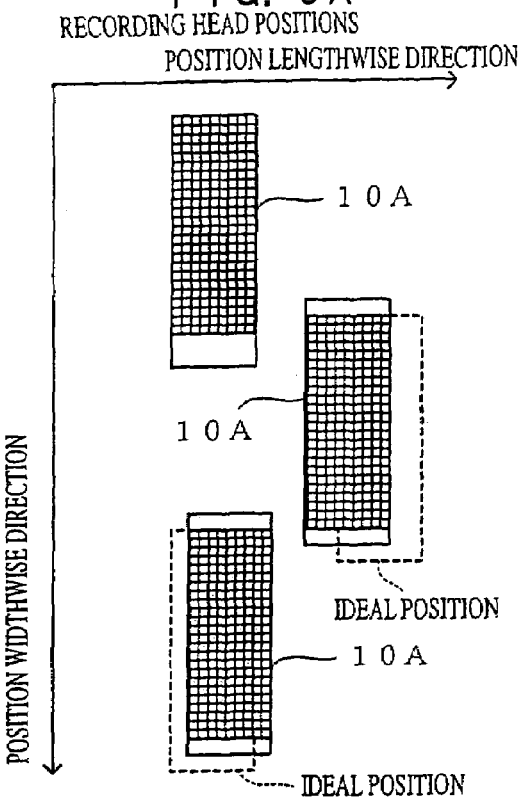
FIGS. 5A through 5D are drawings for explaining correction of recording offset of the unit recording heads.
Figure 5B:
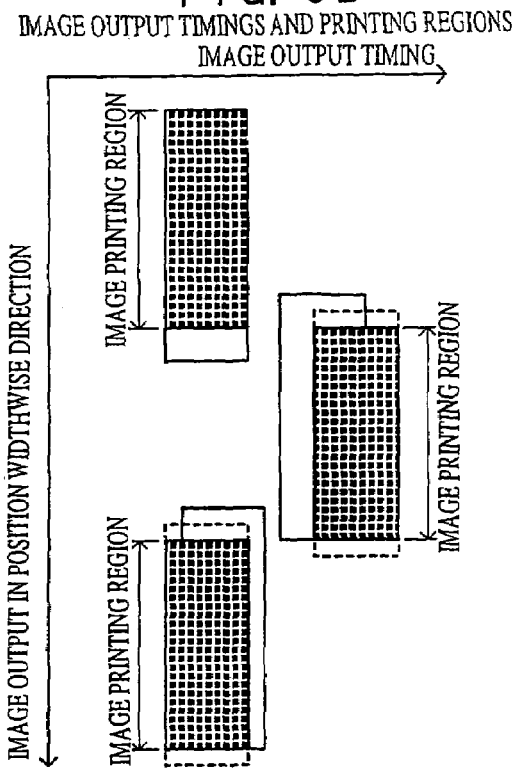
Figure 5C:
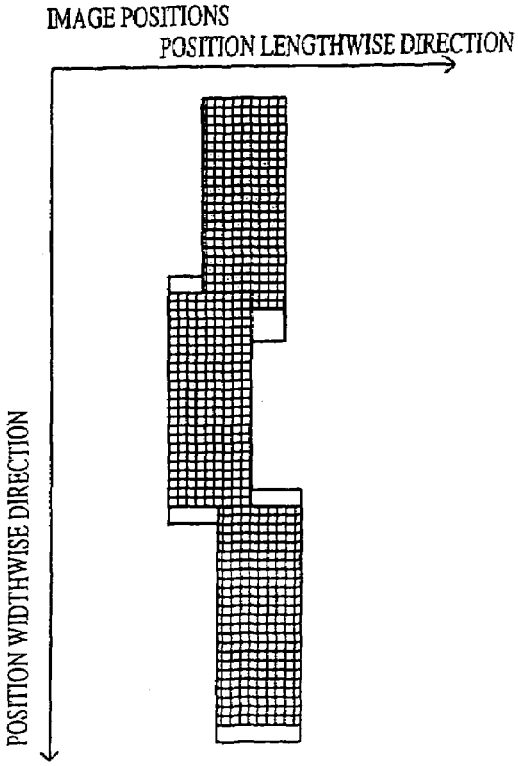
Figure 5D:
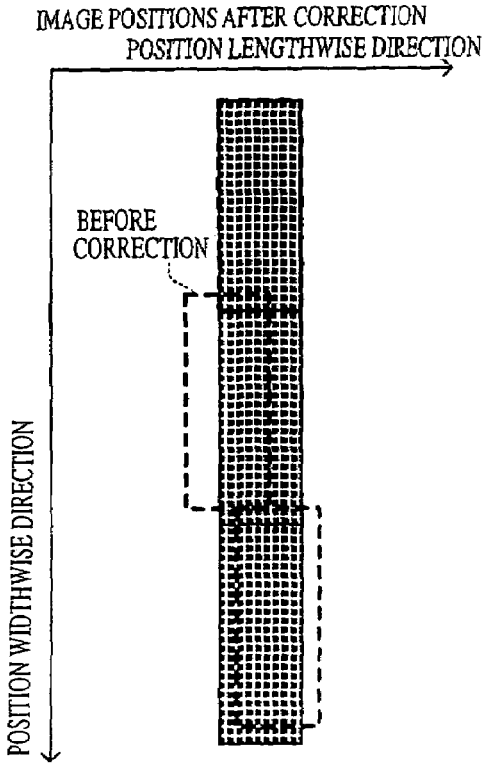

FIG. 5A is a drawing showing the positions of the unit recording heads 10A and the image printing regions before correction. FIG. 5B is a drawing showing image output timing and image printing region correction. FIG. 5C is a drawing showing image positions before correction, and FIG. 5D is a drawing showing image positions after correction.

For example, a case is considered in which, with the unit recording head 10A that is positioned topmost in FIG. 1 being the reference unit recording head 10A, the test patterns 30 are recorded as described above and the image positional offset amounts with respect to the reference unit recording head 10A are detected. In this case, as shown in FIG. 5A, if another unit recording head 10A is offset from the reference unit recording head, when recording is carried out without correcting the image position, positional offset of the images which corresponds to the offset between the unit recording heads 10A arises as shown in FIG. 5C. Note that the dashed lines in FIG. 5A show the ideal positions of the unit recording heads 10A.

In this case, the image positional offset in the direction orthogonal to the recording sheet conveying direction (i.e., the image positional offset in the widthwise direction) is corrected by changing the image output regions (the nozzles) of the respective unit recording heads 10A. Namely, as shown in FIG. 5B, by changing the printing regions of the unit recording heads 10A, overlapping of images and gaps between images arising among the unit recording heads can be eliminated.

Further, the image positional offset in the recording sheet conveying direction (the lengthwise direction) is corrected by changing the image output timings of the unit recording heads 10A. Namely, as shown in FIG. 5B, by recording images by changing the recording timings of the unit recording heads 10A, lengthwise direction nonalignment of the images between the unit recording heads 10A can be eliminated.

Namely, by changing the printing regions of the unit recording heads 10A in accordance with the image position offsets detected by the sensors 12 as described above, the offset of the images in the direction orthogonal to the recording sheet conveying direction can be corrected. By changing the recording timings of the unit recording heads 10A, the offset of the images in the recording sheet conveying direction can be corrected. Note that the image positions after correction are shown in FIG. 5D.

Next, correction of inclined offset of the unit recording head will be described.

Figure 6A:
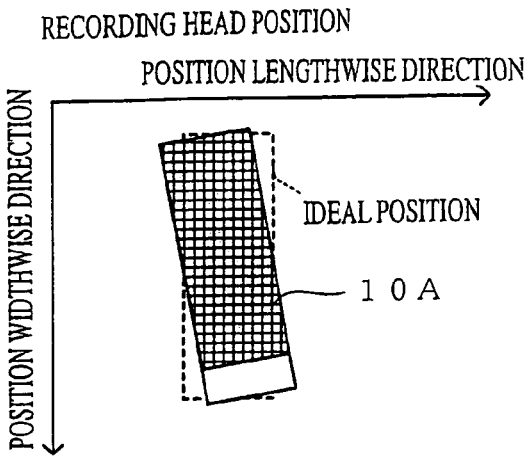
FIGS. 6A through 6C are drawings for explaining correction of recording offset due to inclining of the unit recording head.
Figure 6B:
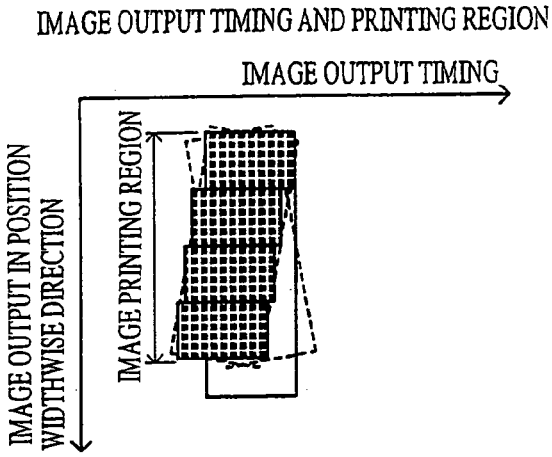
Figure 6C:
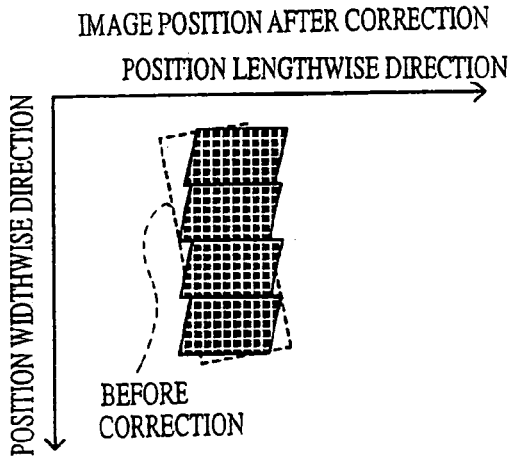

FIG. 6A is a drawing showing the position of the unit recording head 10A and the image printing region before correction. FIG. 6B is a drawing showing image output timing correction and image printing region correction. FIG. 6C is a drawing showing the image position after correction.

For example, a case is considered in which, with the unit recording head 10A that is positioned topmost in FIG. 1 being the reference unit recording head 10A, the test patterns 30 are recorded as described above and the image positional offset amounts (inclinations) with respect to the reference unit recording head 10A are detected. In this case, if another unit recording head 10A is inclined as shown in FIG. 6A with respect to the reference unit recording head 10A, the image will be inclined when recording is carried out without correcting the image position.

The inclining of the image in this case is corrected by dividing the printing region of each unit recording head 10A, and changing discretely (i.e., in a step-wise manner) the image recording timing of each divisional region. Namely, as shown in FIG. 6B, the printing region of the unit recording head 10A is divided in accordance with the inclination of the image. By discretely changing the image recording timings of the respective divisional regions, the inclining of the image can be corrected as shown in FIG. 6C. Note that the changing of the image recording timing may be effected by using one pixel as the changing step and changing the number of divisions in accordance with the amount of inclination offset, or by fixing the number of divisions and changing the number of pixels of the changing step.

In this way, by changing the image output regions (nozzles) of and controlling the recording timings of the respective unit recording heads 10A on the basis of the results of detection of the sensors 12, the relative recording positions of the images recorded by the unit recording heads 10A can be corrected.

Next, the image forming apparatus according to the embodiment of the present invention, which puts into practice a recording head structured as described above, will be explained.

Figure 7:
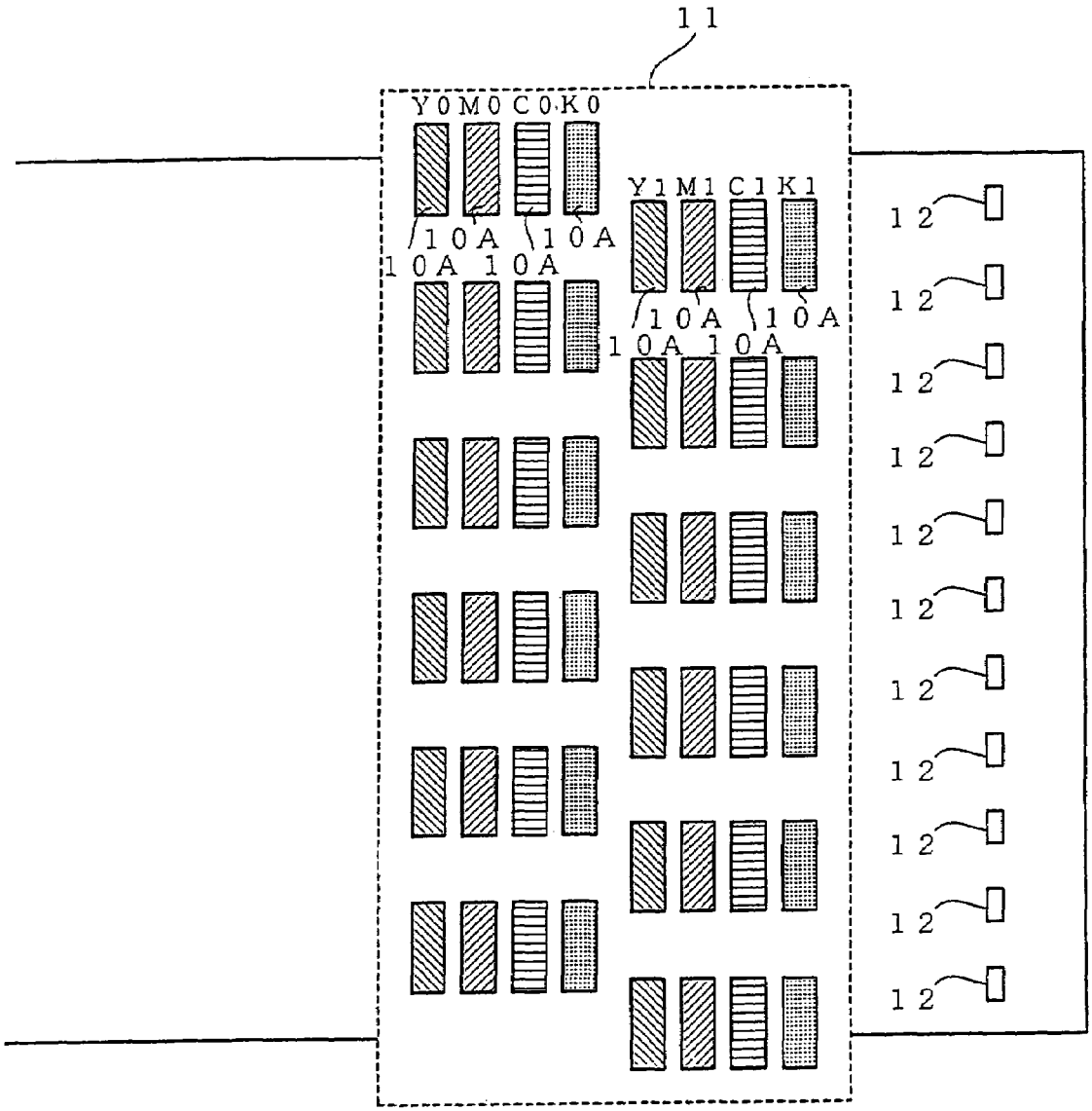
FIG. 7 is a drawing showing the schematic structure of the recording head of the image forming apparatus according to the embodiment of the present invention.

FIG. 7 is a drawing showing the structure of a recording head of the image forming apparatus according to the embodiment of the present invention.

As shown in FIG. 7, a recording head 11 is structured by the plural unit recording heads 10A. The unit recording heads 10A include the unit recording heads 10A (Y0 and Y1 in FIG. 7) recording yellow images, the unit recording heads 10A (M0 and M1 in FIG. 7) for recording magenta images, the unit recording heads 10A (C0 and C1 in FIG. 7) for recording cyan images, and the unit recording heads 10A (K0 and K1 in FIG. 7) for recording black images.

The unit recording heads 10A of the four colors are lined-up along the recording sheet conveying direction. The unit recording heads 10A of the four colors form one block, and the recording head 11 is structured by the blocks being lined-up in a staggered form along the direction orthogonal to the recording sheet conveying direction. The recording head 11 is structured by two columns of blocks which are lined-up in the direction orthogonal to the recording sheet conveying direction. The left side column of blocks in FIG. 7 will be called group 0, and the right side column of blocks in FIG. 7 will be called group 1.

Adjacent blocks are disposed so as to have regions which overlap in the transverse direction of the recording sheet (overlapping regions). Note that it is possible to utilize a structure which does not have overlapping regions.

Namely, by, as the recording sheet is being conveyed, controlling the recording timings of the unit recording heads 10A disposed along the width of the recording sheet, images of the respective colors are superposed such that recording of a color image is possible.

In the same way as the above-described basic structure, the recording head 11 has the sensors 12 for detecting positional offset due to the assembly accuracy or the like of the respective unit recording heads 10A. The sensors 12 are provided so as to correspond to positions between the respective blocks. In further detail, the sensors 12 are provided at least at positions of detecting the images recorded by the nozzles corresponding to the overlapping regions between the unit recording heads 10A. Note that, as mentioned previously, CCD sensors or the like may be employed as the sensors 12.

Figure 8A:
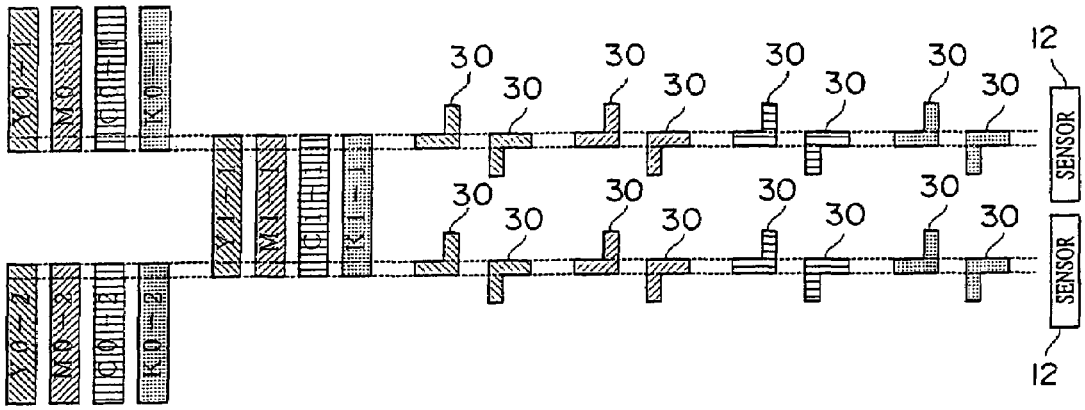
FIGS. 8A and 8B are drawings for explaining test patterns for detecting recording offset of the unit recording heads.

In the same way as the above-described basic structure, the image forming apparatus according to the embodiment of the present invention records the test patterns 30 for correcting the positional offset of the unit recording heads 10A (see FIG. 8A). By detecting the test patterns 30 by the sensors 12, the positional offset of the unit recording heads 10A is corrected.

The control system of the image forming apparatus according to the present embodiment is substantially the same as the basic structure of the above-described control system, and differs only with respect to the point that the unit recording heads 10A, which are connected to the unit recording head recording control section 24, are provided for each color. Thus, detailed description will be omitted.

Next, the detection of the recording position offset between the respective unit recording heads 10A will be described.

As shown in FIG. 8A, each of the unit recording heads 10A records one L-shaped test pattern directed in the lengthwise direction (the recording sheet conveying direction) and one L-shaped test pattern directed in the widthwise direction (the direction orthogonal to the recording sheet conveying direction). The recording positions are such that the test patterns are recorded at positions of the junctures of the respective unit recording heads 10A. In consideration of the offset amount between the unit recording heads 10A of each color (e.g., Y0-1 and Y1-1 in FIG. 8A) or the offset amount between the unit recording heads 10A of different colors (e.g., Y0-1 and M0-1 in FIG. 8A) (the offset amount can be learned from the manufacturing/mounting tolerance of each unit recording head 10A), the recording interval is set such that the test patterns are recorded so as not to overlap and so as to be spaced apart by an interval which is greater than or equal to the allowable offset amount. The recorded positions of the respective test patterns are detected by the test patterns 30 being detected by the sensors 12.

Figure 9:
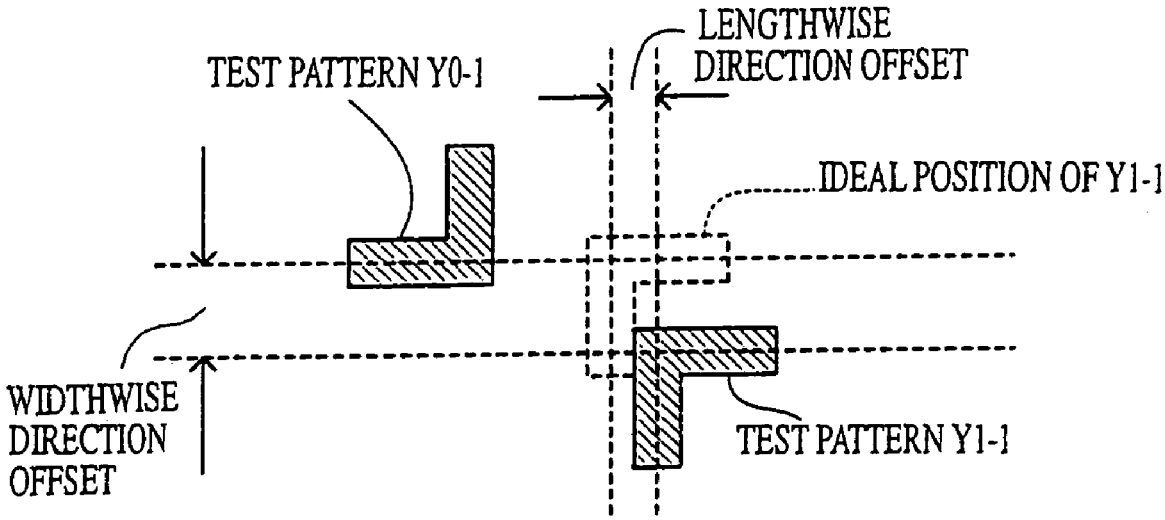
FIG. 9 is a drawing showing a state in which offset has arisen in the lengthwise and widthwise directions in the test pattern.

FIG. 9 shows a state in which offset in the lengthwise and widthwise directions has arisen at the test pattern 30. The test pattern 30 at the left side in FIG. 9 is test pattern Y0-1 recorded by unit recording head Y0-1, and the test pattern 30 at the right side in FIG. 9 is test pattern Y1-1 recorded by unit recording head Y1-1.

Hereinafter, the test pattern recorded by the unit recording head 10A (Y0-1) is called test pattern Y0-1, and the test pattern recorded by unit recording head 10A (Y1-1) is called test pattern Y1-1. Further, in the following explanation, when the respective unit recording heads 10A are to be differentiated as individual unit recording heads 10A, they will be termed, for example, unit recording head Y0-1 as shown in FIG. 8A. In this reference symbol for each unit recording head, the letter represents the color (Y: yellow, M: magenta, C: cyan, K: black), the number which follows expresses whether that unit recording head is positioned in group 0 or group 1, and the number after the hyphen expresses which row that unit recording head is positioned in from the end of the recording head 10.

The dashed lines in FIG. 9 show the ideal state of test pattern Y1-1. Test pattern Y1-1 is recorded with offset by the lengthwise direction offset amount and the widthwise direction offset amount shown in FIG. 9. Here, there is no problem provided that the absolute positional offset from the ideal position can be detected, but precisely learning of the absolute positional offset may be difficult because of the mounting accuracy and the detection timing of the sensors 12, fluctuations in the moving speed of the test pattern, and the like. Thus, the relative offset is detected by using test pattern Y0-1 as the reference. For example, the offset between test pattern Y0-1 and test pattern Y1-1, i.e., the lengthwise direction offset between unit recording head Y0-1 and unit recording head Y1-1, is used. Further, similarly, for the widthwise direction offset, the offset of the line segment extending in the lengthwise direction is measured and is used as the widthwise direction offset between the unit recording heads 10A.

Explanation has been given above of detecting the offset amount between unit recording heads 10A of the same color (the offset amount between test pattern Y0-1 and test pattern Y1-1). However, the detection of positional offset is similarly possible for unit recording heads 10A other than yellow, such as between unit recording head M0-1 and unit recording head M1-1, unit recording head C0-1 and unit recording head C1-1, and unit recording head K0-1 and unit recording head K1-1. Further, the offset amount between different colors as well can be detected if the relative positional offsets between test pattern Y0-1 and test pattern M0-1, test pattern Y0-1 and test pattern C0-1, and test pattern Y0-1 and test pattern K0-1 are learned of. Here, test pattern Y0-1 is used as the reference, but test pattern Y1-1 may be used as the reference, and the offset of test pattern Y0-1 may be detected. The test pattern of another color other than yellow may be used as the reference to detect relative positional offset. The detection of relative positional offset between the unit recording heads 10A has been described, but the absolute positional offsets of the test patterns of the respective unit recording heads 10A with respect to the sensors 12 may be detected. If the absolute positional offsets of the respective unit recording heads 10A are detected and these offsets can be corrected, the image registration offset with respect to the recording sheet can be lessened.

Further, explanation has been given of detecting the offset between the unit recording heads 10A of the same color, i.e., the unit recording heads Y0-1 and Y1-1, or of detecting the offset between unit recording heads 10A of different colors (the offset between unit recording head Y0-1 and unit recording head M0-1), which offsets are at the widthwise direction end portion (the end portion in the direction orthogonal to the recording sheet conveying direction). However, the positional offset between images of the unit recording heads 10A can be detected by, in the case of offset between unit recording heads 10A of the same color, detecting the offset between unit recording head Y1-1 and unit recording head Y0-2 and the offset between unit recording head Y0-2 and unit recording head Y1-2 (and thereafter, detecting positional offset similarly between adjacent unit recording heads 10A of the same color), or, in the case of offset between unit recording heads 10A of different colors, detecting the offset between unit recording head Y1-1 and unit recording head M1-1 and the offset between unit recording head Y0-2 and unit recording head M0-2 (and thereafter, detecting offset similarly with respect to cyan and black as well).

Figure 8B:
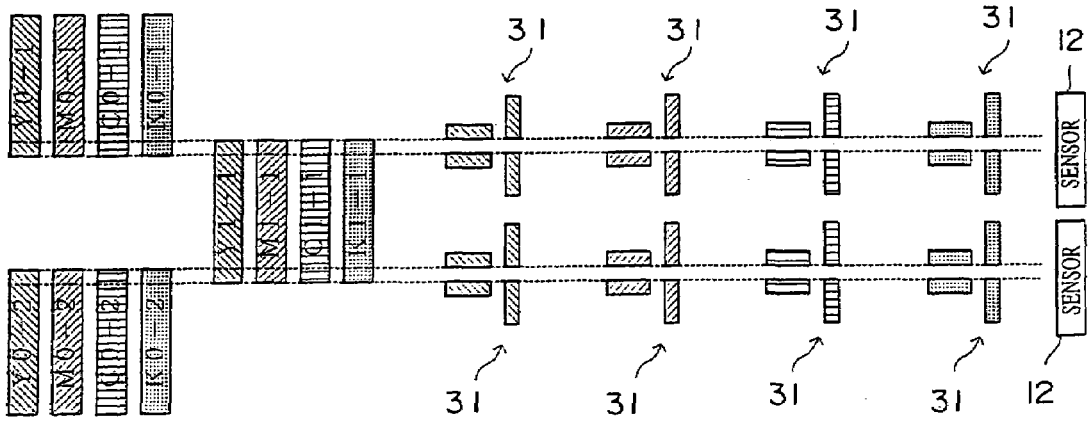

Note that, as shown in FIG. 8B, positional offset between the unit recording heads 10A can be detected also by using another test pattern 31. Only the configuration of the test pattern is different, but detecting the offset amounts of the test patterns in the lengthwise direction and the widthwise direction is the same. In this case, the recording of test pattern Y0-1 and test pattern Y1-1 (the same holds as well for the other colors), is carried out at the same position in the lengthwise direction. Thus, when there are fluctuations in the recording position in the lengthwise direction, more accurate detection than with the test patterns 30 shown in FIG. 8A is possible. Further, by forming a constant gap at the overlap region of the unit recording heads 10A of the same color (Y0 and Y1) and measuring the length of this gap, the offset between adjacent unit recording heads 10A of the same color can be detected with high accuracy.

FIGS. 8A and 8B each show an example in which one test pattern 30, 31 is recorded by each of the unit recording heads 10A. However, in a case in which there are periodic fluctuations or in a case in which the detection error in the detecting of one test pattern is large, plural test patterns may be recorded by each of the unit recording heads 10A and the detection values can be averaged, so as to improve the accuracy of detection.

Moreover, in a case in which there are periodic fluctuations, the period of the test pattern and the recorded length of the test pattern must be considered in order to be able to learn of the registration fluctuation in at least a length of the period. For example, if there is a periodic fluctuation of 150 mm, the test pattern recording length should be at least one period (150 mm) or an integer multiple of that period (e.g., 300 mm or 450 mm or the like). If many test patterns (at least two) can be recorded within the range of one fluctuation period, a test pattern period in which an integer number of test patterns (an even number of test patterns) can be recorded should be used (a 75 mm period if there are two test patterns), and if it is not possible to record at least two test patterns within one fluctuation period, a period which is not synchronous with the fluctuation period (225 mm which is offset by half a period from the fluctuation period, or a period which is offset by 1/integer period, or the like) and which is at least two period fluctuations (when offset by 1/integer period, a period equal to the integer multiple of the fluctuation period) should be used.

Next, correction of offset between unit recording heads 10A of the same color will be described. FIG. 10 is a drawing for explaining correction of recording position offset between adjacent unit recording heads 10A of the same color.

Figure 10A:
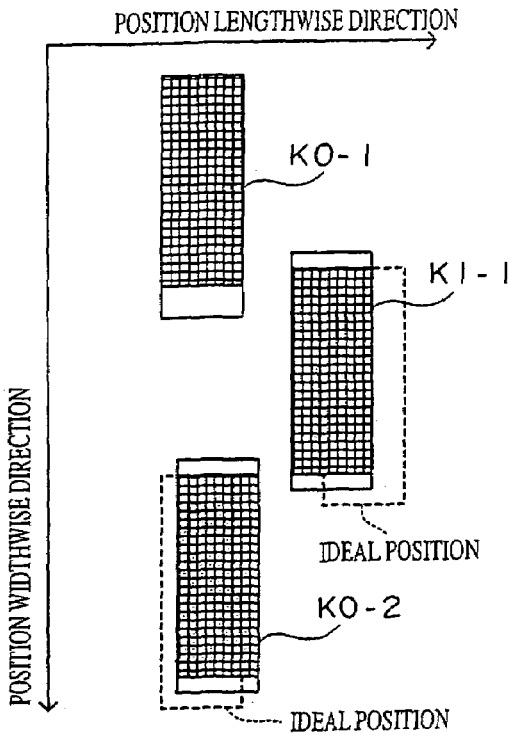
FIGS. 10A through 10D are drawings for explaining recording position offset correction between adjacent unit recording heads of the same color.
Figure 10B:
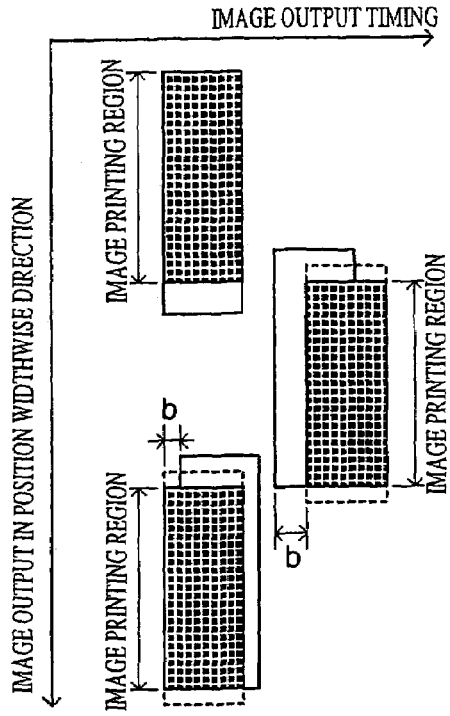
Figure 10C:
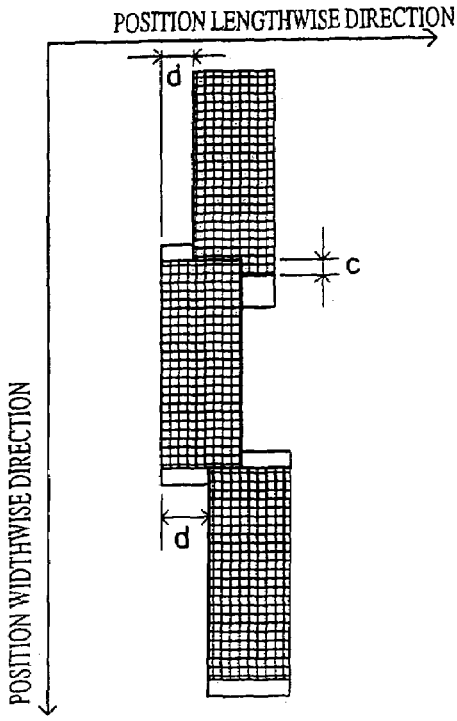

Image recording positions in a state in which unit recording heads K0-1, K1-1 and K0-2 are offset as shown in FIG. 10A, are shown in FIG. 10C. Reference letter c in FIG. 10C indicates the image position offset in the widthwise direction (the direction orthogonal to the recording sheet conveying direction), and d indicates the offset in the lengthwise direction (the recording sheet conveying direction).

The image position offset c in the widthwise direction is corrected by changing the image output regions (the nozzles) of the unit recording heads 10A. By changing the image recording regions, which are the image recording regions before correction shown in FIG. 10A, to the image recording regions after correction shown in FIG. 10B, the overlapping of the images of the unit recording heads K0-1 and K1-1, and the gap between the images of the unit recording heads K1-1 and K0-2 can be eliminated.

The image position offset d in the lengthwise direction is corrected by changing the image output timings of the unit recording heads 10A. By correcting from the image output timings before correction in FIG. 10A by the image output timing amounts b shown in FIG. 10B and making the timings be the image output timings after correction shown in FIG. 10B, non-alignment in the lengthwise direction between the unit recording heads 10A can be eliminated.

Figure 10D:
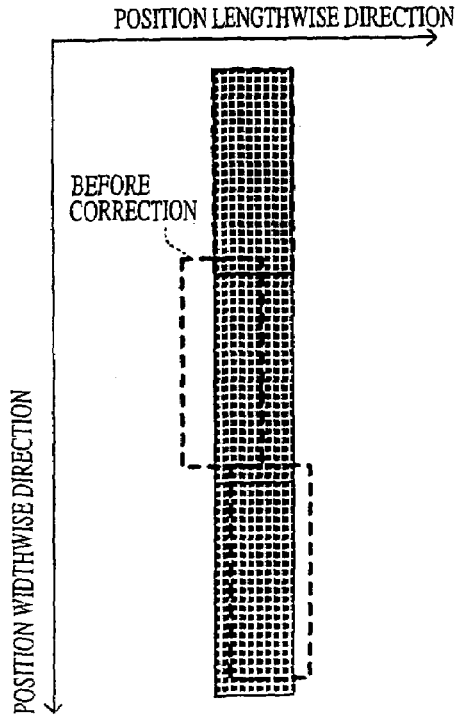
Figure 11A:
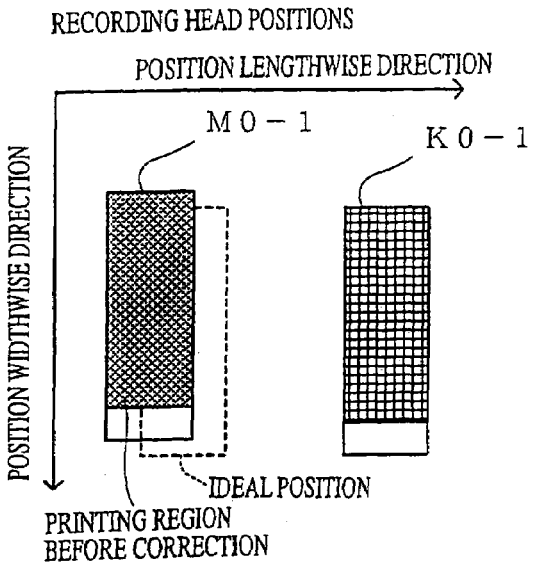
FIGS. 11A through 11D are drawings for explaining offset correction between unit recording heads of different colors.
Figure 11B:
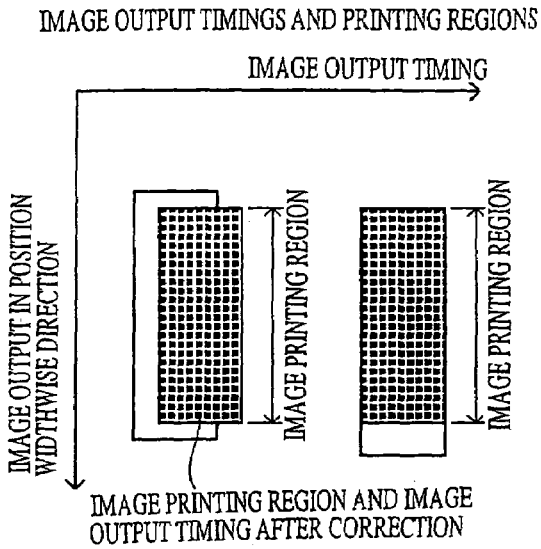
Figure 11C:
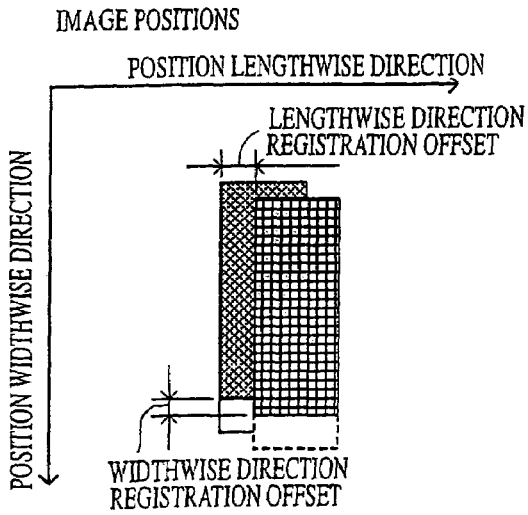
Figure 11D:
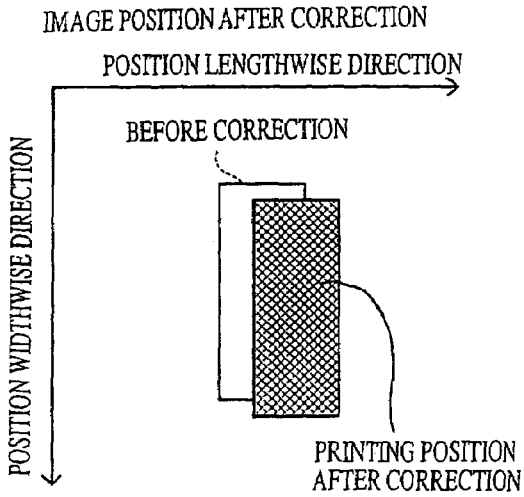

FIG. 10D shows the image output positions after the offsets in the widthwise direction and the lengthwise direction have been corrected. In this example, the recording region of the reference unit recording head K0-1 is not changed. However, correction may be carried out by dispersing, between the unit recording heads K0-1 and K1-1, the correction amount of the offset between the unit recording heads K0-1 and K1-1. In this case, it suffices for the amount of change of the recording region of the unit recording head K1-1 toward the unit recording head K0-1 side to be half.

Further, in the example of FIG. 10, the output nozzles of each of the unit recording heads 10A are lined-up in two dimensions as m×n. However, the detection and correction of positional offset of images can be carried out not only in such an arrangement, but also similarly in a one-dimensional arrangement of m×1.

FIG. 11 is a drawing for explaining offset correction between unit recording heads 10A of different colors. The method of correction is similar to the above-described correction of offset between unit recording heads 10A of the same color. The widthwise direction offset can be corrected by changing the image output regions, and the lengthwise direction offset can be corrected by changing the image output timings.

Next, correction of inclination offset of the unit recording heads 10A will be described. FIG. 12 is a drawing for explaining correction of image inclination (skewing) offset caused by inclining of the unit recording head 10A.

Figure 12A:
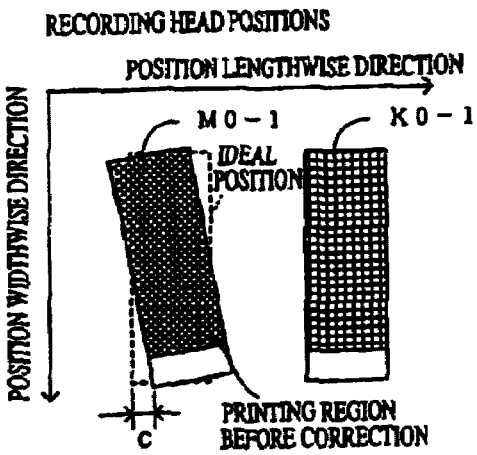
FIGS. 12A through 12D are drawings for explaining correction of image inclination (skewing) offset caused by inclining of the unit recording head.
Figure 12B:
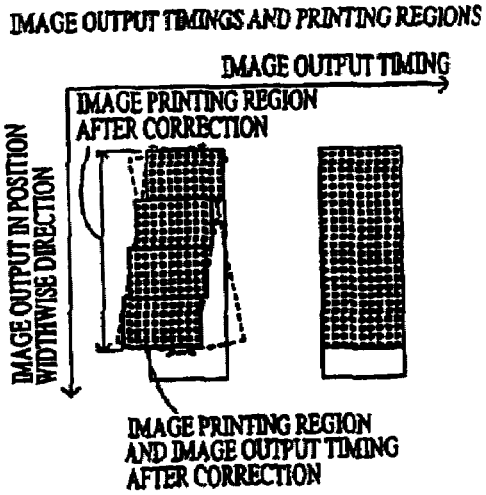
Figure 12C:
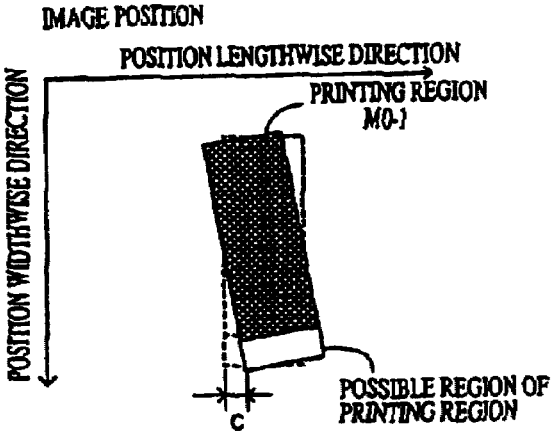
Figure 12D:
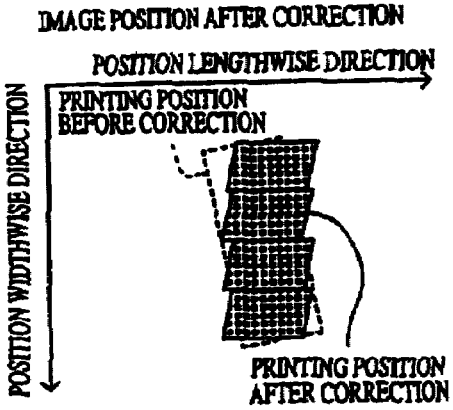

As shown in FIG. 12A, when magenta unit recording head M0-1 is inclined in the lengthwise direction with respect to unit recording head K0-1 of black which is the reference color, the image output position is as shown in FIG. 12C. Reference letter c in FIG. 12C is the skew of the image (lengthwise direction offset caused by inclining of the unit recording head 10A also arises). Correction is carried out by dividing the unit recording head 10A into plural sections (four sections in FIG. 12), and, as shown in FIG. 12B, changing the image output timings discretely (i.e., in a stepwise manner). The image output positions after changing the image output timings are shown in FIG. 12D. The changing of the image output timings may be carried out by using one pixel as the changing step and changing the number of divisions in accordance with the amount of inclination offset, or by fixing the number of divisions and changing the number of pixels of the changing step. In order to lessen jaggedness of the edges at the same unit recording head 10A, it will be more effective to fix the changing step to one pixel and to change the number of divisions in accordance with the amount of inclined offset.

The above-described changing of the image output timings may be carried out by outputting while changing the data storage positions read-out at the time of output without changing the data in the image memory, or may be carried out by outputting the image by changing the image data in the image memory (a buffer memory may be provided) without changing the read-out data positions. With these methods, it is possible to control the changing of the output timing of specific image data.

Next, image offset detection and correction processings when offset between the same color, offset between different colors, and inclined offset are combined, will be described.

Figure 13:
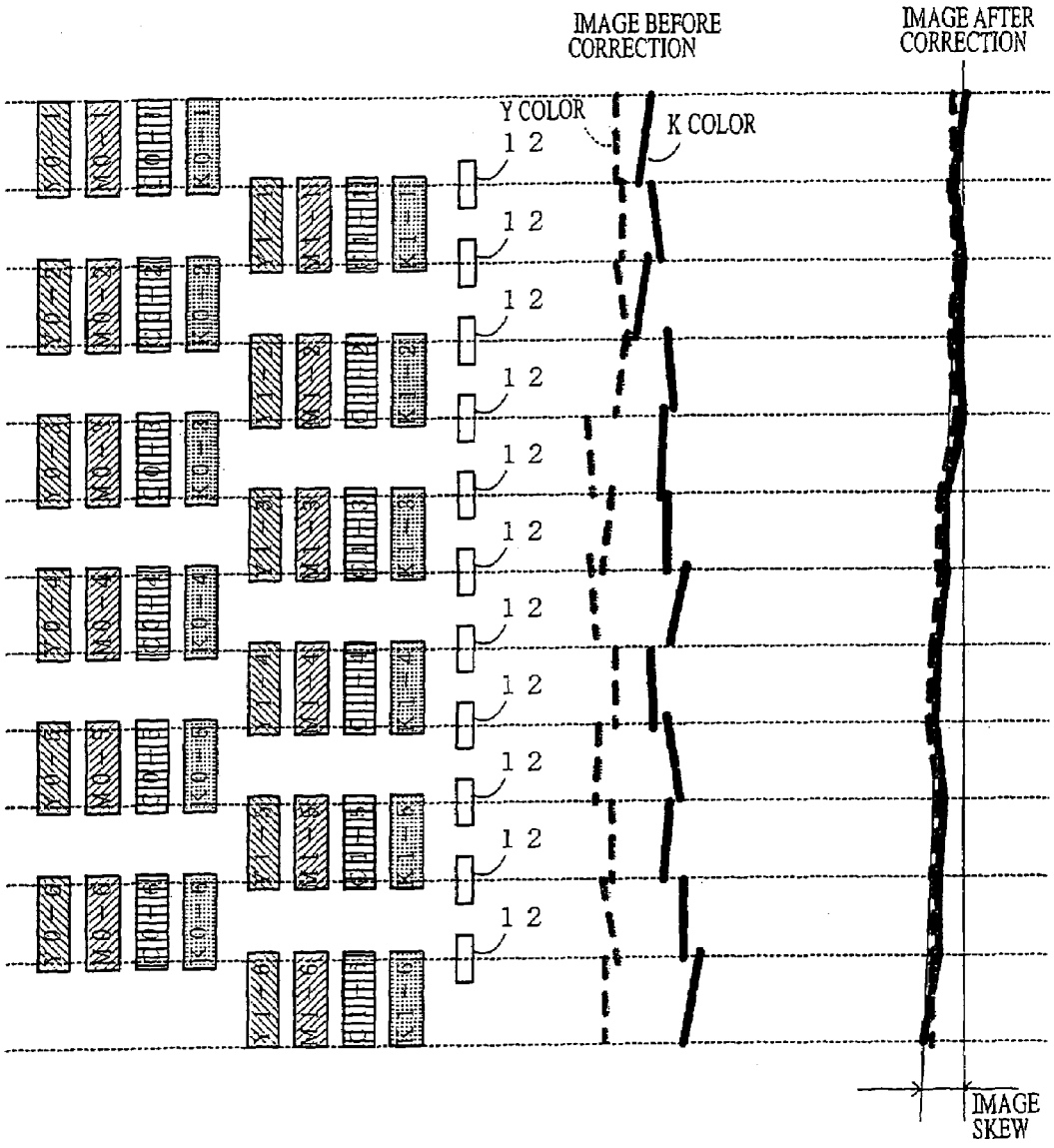
FIG. 13 is a drawing showing offset before and after correction when recording by using black and yellow unit recording heads.

FIG. 13 shows offsets before and after correction when recording by using black and yellow unit recording heads 10A. The plural sensors 12 are disposed at the positions where the respective unit recording heads 10A are adjacent. (In FIG. 13, the unit recording heads 10A are divided into twelve in the widthwise direction, and there are therefore eleven sensors 12.) Correction is carried out so as to eliminate offset between adjacent portions of the single reference color (black in this example) as described above, and the color which is the object of correction at the same position in the lengthwise direction (yellow in this example) is corrected such that the output images of the respective unit recording heads 10A match the reference color.

However, in this example, as shown by the image after correction of FIG. 13, there are cases in which image skewing arises in the image after correction due to inclining of the unit recording head K0-1 of the reference color K. Such image skewing arises due to the inability to learn of the absolute offset of the inclining of the unit recording head K0-1 of the reference color K due to inclining of the sensors 12 themselves which is caused by dispersion in the mounting of the individual sensors 12 or the like.

Figure 14:
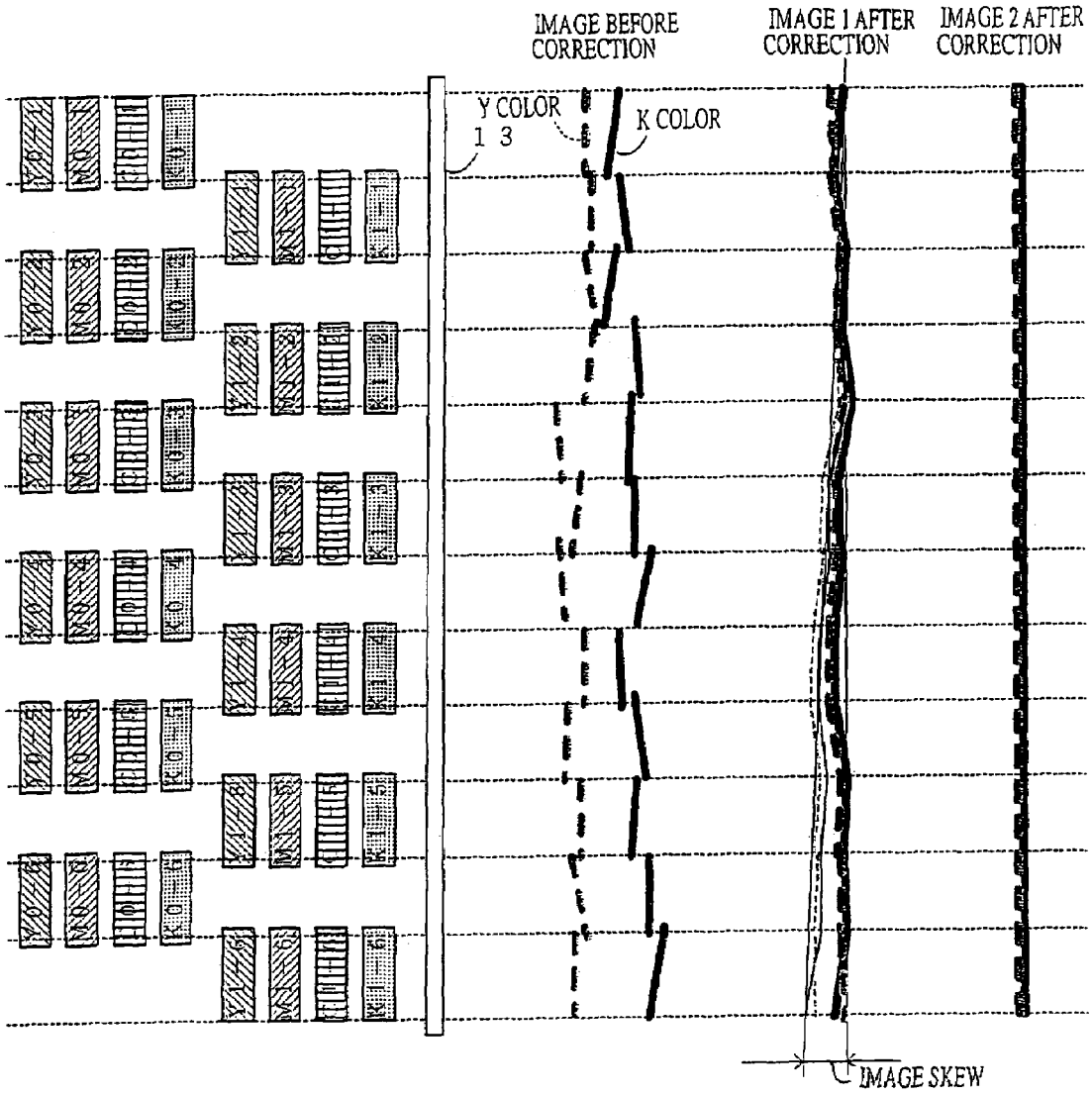
FIG. 14 is a drawing showing offset before and after correction in an example in which adverse effects due to inclining of a sensor are improved.

FIG. 14 shows an improvement example to address the above problem. The divided sensors 12 as shown in FIG. 13 are not used, and a full-line-type sensor 13, which can detect all of the output images of the unit recording heads 10A in the widthwise direction, is used. It is thereby possible to correct the inclinations of the respective unit recording heads 10A by using the same reference, and the image skewing offset shown in FIG. 13 can be suppressed to a certain extent as shown by image 1 after correction in FIG. 14.

Even when the plural sensors 12 are used as shown in FIG. 13, the inclinations of the respective unit recording heads 10A can be detected if the offset of each of the sensors 12 which has arisen at the time of the manufacturing and mounting thereof can be known. The following methods are examples of methods of detecting the offsets of the sensors 12.

(A) A mark recorded in advance on the recording sheet or on a belt for conveying the recording sheet or the like (e.g., a straight line running along the direction in which the sensors 12 are lined-up, or the like), is detected by the sensors 12. The offsets of the respective sensors 12 are detected, and are corrected at the same time at the time of correcting the offsets of the unit recording heads 10A.

(B) An end portion of the recording sheet is detected by the sensors 12, and in the same way as mentioned above, the offsets of the sensors 12 are corrected at the same time at the time of correcting the offsets of the unit recording heads 10A.

(C) A test pattern 30 recorded on the recording sheet is detected by the sensors 12, and the same test pattern is measured by an external measuring device. The errors therebetween are corrected at the same time at the time of correcting the offsets of the unit recording heads 10A.

By applying such a method, the recording offset can be corrected such as in image 2 after correction of FIG. 14, and offset in detection which is caused by the mounting tolerance of the sensors 12 themselves can be corrected. Further, also when the full-line-type sensor 13 is used, by applying a method such as described above, offset in detection which is caused by the mounting tolerance of the sensor 13 itself can be corrected, and the recording offset of the image can be corrected highly precisely.

Next, another example of the detection and correction of image offset when offset between the same color, offset between different colors, and inclined offset are combined, will be described.

Figure 15:
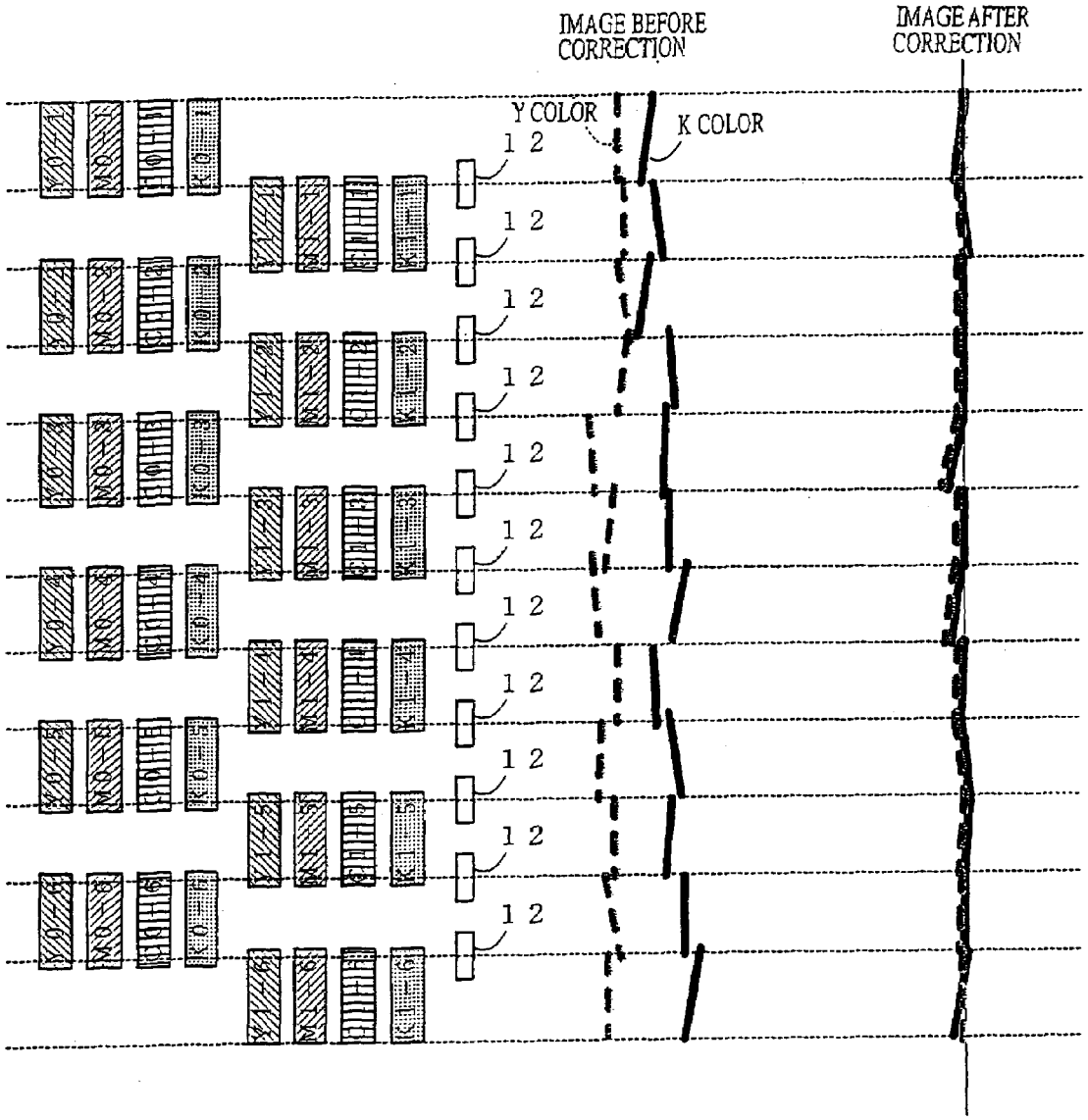
FIG. 15 is a drawing showing offset before and after correction when recording by using black and yellow unit recording heads in another example of detection and correction of image offset.

FIG. 15 is a drawing showing offset before and after correction when recording is carried out by the black and yellow unit recording heads 10A in another example of image offset detection and correction. In this example, the edges of adjacent unit recording heads 10A are not matched, but rather, by using the black unit recording head K0-1 which is furthest toward the edge in FIG. 15 as a reference, the positions of the output images of the other black unit recording heads 10A and the yellow (the same holds for magenta and yellow as well) unit recording heads 10A are matched.

Figure 16:
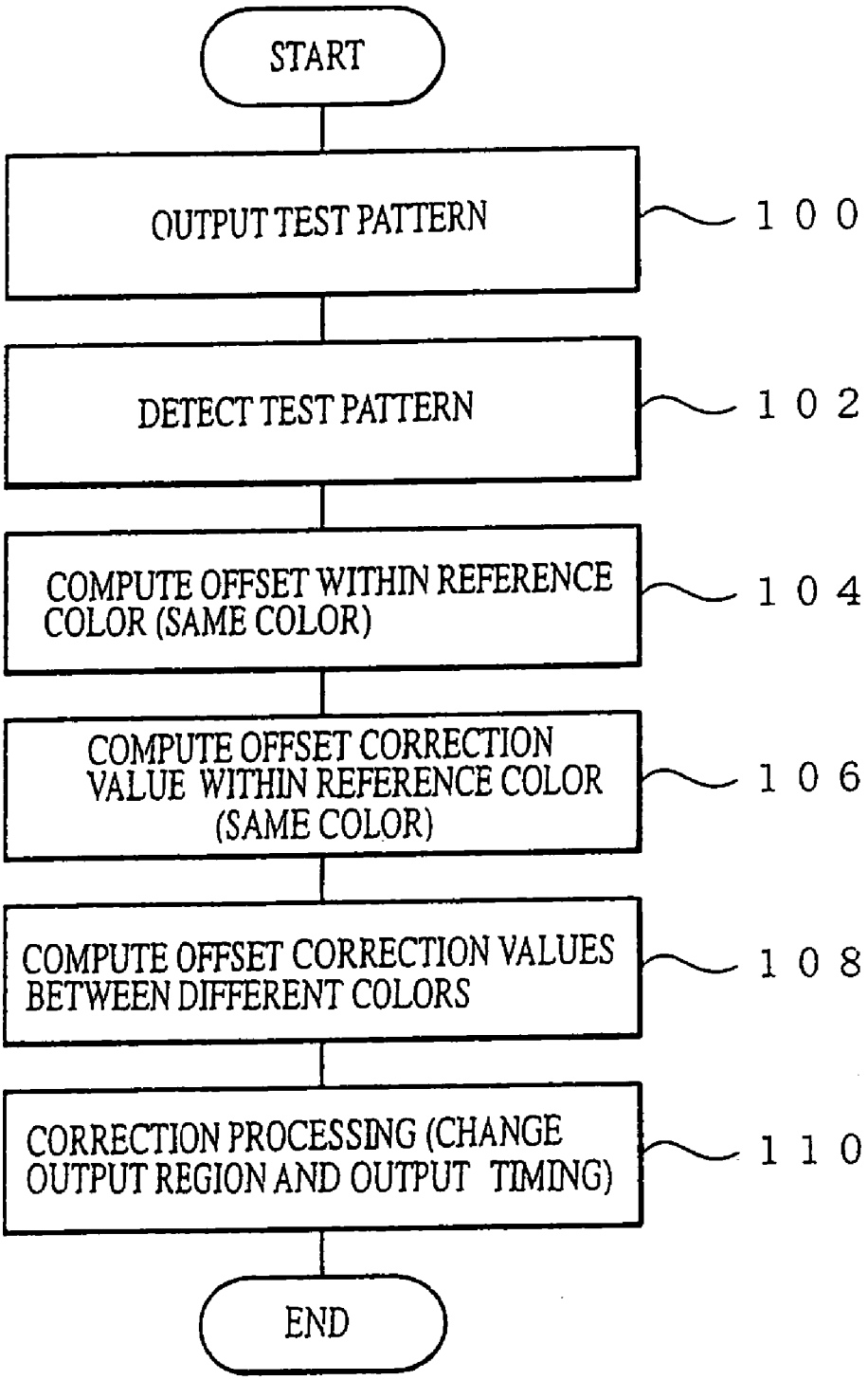
FIG. 16 is a flowchart showing the flow of processing of detection and correction in the example of FIG. 15.

FIG. 16 is a flowchart showing the flow of detection and correction processings in the example of FIG. 15.

First, when an instruction for registration adjustment is inputted to the image forming apparatus from the input device 16 or an external computer or the like, in step 100, the recording sheet or the like is conveyed to the position of the recording head 10, and the test patterns 30 are recorded successively thereon.

Figure 17:
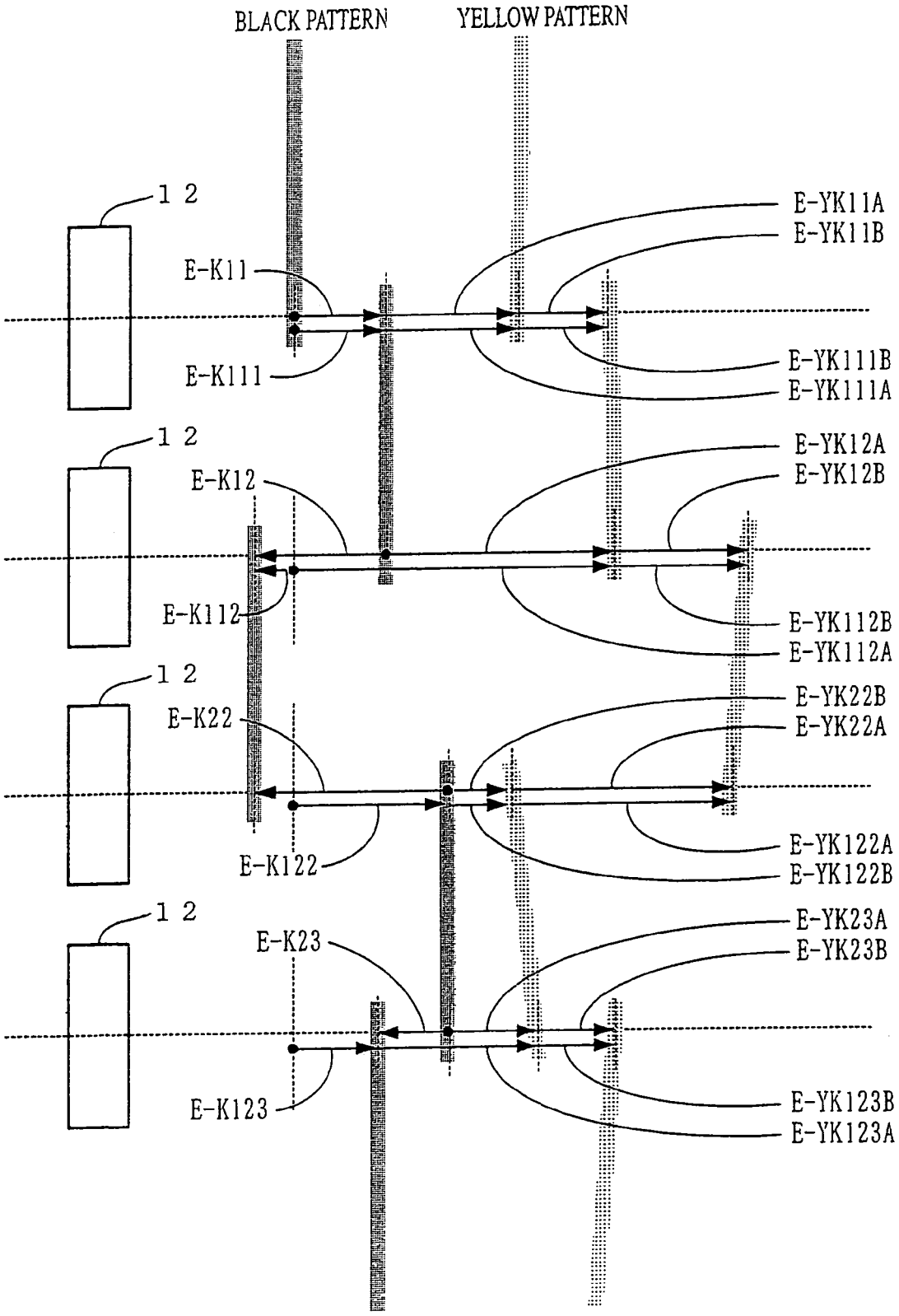
FIG. 17 is a drawing showing offset amounts between the unit recording heads.

In step 102, the recorded test patterns 30 are successively detected by the sensors 12 which are provided at the image forming apparatus. FIG. 17 is a drawing showing the amounts of offset between the unit recording heads 10A at this time. The detected offset amounts are the relative offset amounts of the output patterns of the unit recording heads 10A adjacent to the reference color black (E-K11, E-K12, and the like in FIG. 17), and the yellow offset which includes the offset with respect to the output pattern of the adjacent reference color unit recording head 10A, and the relative offset with respect to the output pattern of the same reference color unit recording head 10A in the lengthwise direction (E-YK11A, E-YK11B, and the like in FIG. 17).

Then, in step 104, on the basis of the positions of the test patterns 30 detected by the sensors 12, the offsets within the reference color (the same color) are computed as described above. In step 106, correction values for offset within the reference color (the same color) are computed. In step 108, correction values for offset between different colors are computed.

For example, as shown in FIG. 18, the offsets of the output patterns of the respective black and yellow unit recording heads 10A when the unit recording head K0-1 at the end of the reference color is used as the reference (the reference does not have to be the black unit recording head 10A at the edge; another color can be used as the reference, or another unit recording head 10A at the center or the like can be used as the reference), are computed (in FIG. 17, E-K111, E-K112, and E-YK111A, E-YK111B, and the like). The offset amounts of the respective unit recording heads 10A are shown in FIG. 18. Note that FIG. 18A shows offsets when, among the adjacent unit recording heads 10A, the unit recording head 10A which is close to the unit recording head K0-1 of the reference color black is used as the reference. FIG. 18B shows offsets when the unit recording head K0-1 of the reference color black is used as the reference for all. Further, the skew offset amounts of yellow with respect to the reference color black are computed as shown in FIG. 18C. In this example, the correction amounts are the positive/negative reverses of the computed offset amounts, and are computed as shown in FIG. 19.

Next, in step 110, correction processing is carried out. Namely, the image printing regions and the output timings are changed as described above in accordance with the respective computed correction values. In this way, the offsets of the respective unit recording heads 10A can be corrected as is shown by the image after correction of FIG. 15.

In the above description, image output position offset caused by offset of the positions of the unit recording heads 10A includes initial offset at the time of assembling the device (hereinafter called "shipping time offset"), and offset arising due to changes at the time when the device is transported or warping of the floor surface on which the device is set or the like (hereinafter called "setting time offset"), and the like.

With regard to shipping time offset and setting time offset, it suffices to record the aforementioned test patterns 30 at the time of shipping and the time of setting, and to correct the positions of the output images of the respective unit recording heads 10A (registration adjustment). Further, in addition thereto, registration adjustment may be carried out when the power of the device is turned on, when the device wakes after having been in an energy-saving mode, when the device recovers after there has been trouble therewith, after maintenance operations on the device have been completed, when modules of the device (including the unit recording heads 10A, the belts, the sensors, and the like) are replaced, and the like.

Figure 20:
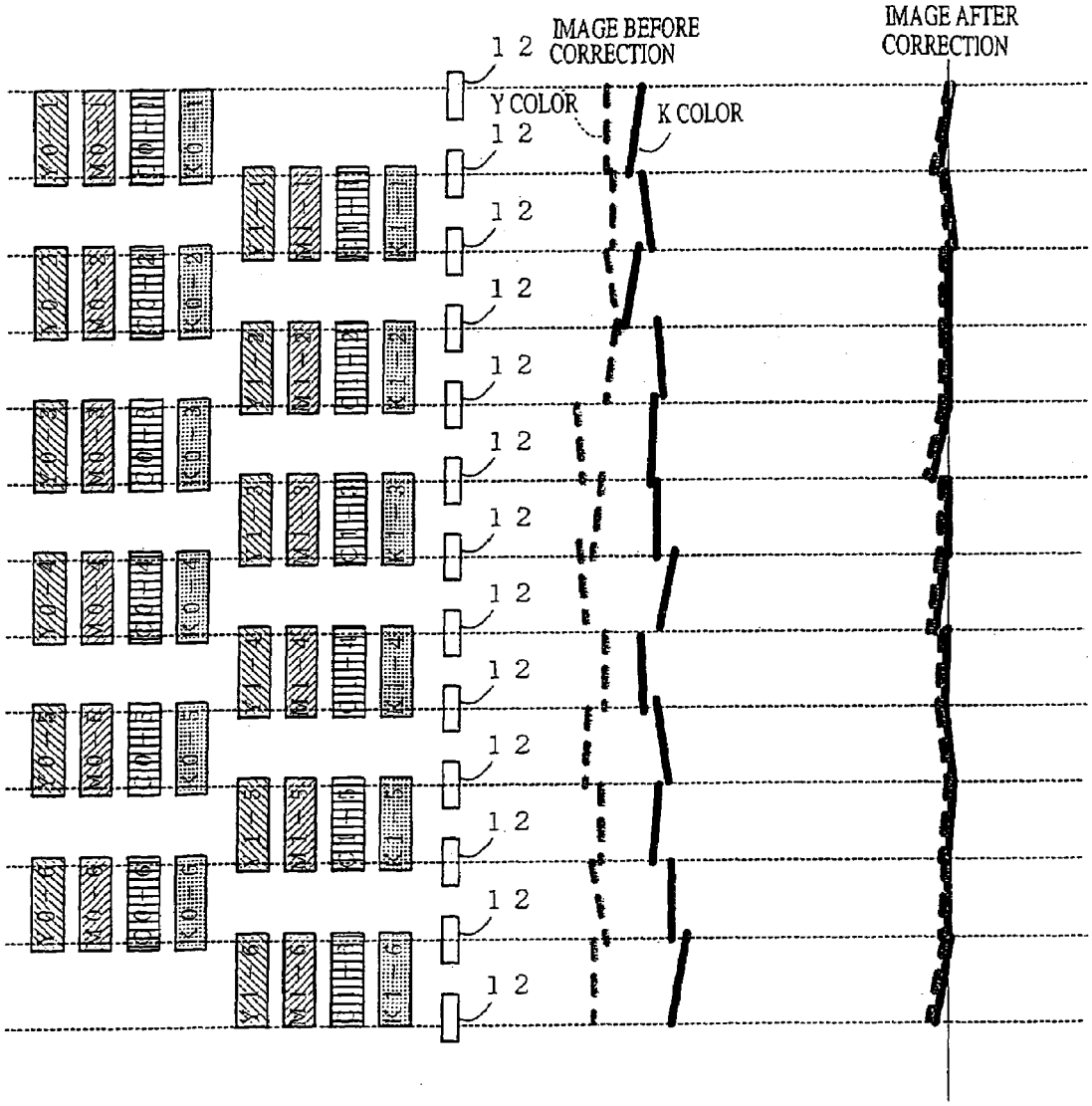
FIG. 20 is a drawing showing an example in which sensors are added to both ends.

The above embodiment describes an example in which eleven of the sensors 12 are provided with respect to the twelve divisions in widthwise direction of the unit recording heads 10A. However, here, the skewing offset at the both widthwise direction ends (Y0-1 and Y1-1) cannot be detected. Thus, as shown in FIG. 20, a structure may be used in which the sensors 12 are added at the both ends, so that all of the skew offset amounts can be detected. In this way, as shown in FIG. 20, the skew offset can be corrected at the unit recording heads 10A at the both ends of the recording head 10 as well. The image positions before and after correction at this time are shown as the image after correction in FIG. 20. Accordingly, when the recording head 10 according to the embodiment of the present invention is divided into the unit recording heads 10A, if the number of divisions in the direction orthogonal to the moving direction of the recording sheet is N, by providing (N−1) or (N+1) sensors 12, the recording offsets among the respective unit recording heads 10A can be corrected.

Further, the structure of the unit recording head 10 is not limited to the above-described embodiment. The plural unit recording heads 10A may be formed into a unit, and this unit may be installed in the device overall. In this case, the unit recording head mounting tolerance within the unit is small as compared with the tolerance for each unit. Further, the tolerance within the recording head unit is substantially that at the time of manufacturing and assembly, and the amount of change thereafter can be made to be small. Accordingly, when the recording head unit is manufactured and shipped out, if the offsets of the unit recording heads 10A within the unit are measured, these amounts are stored, and the image outputs are always corrected by those amounts after device set-up, the tolerance of the unit recording heads 10A within the unit can be reduced. Further, in this case, after set-up of the device, it suffices to detect and correct the offset amounts for each of the recording head units.

Figure 21C:
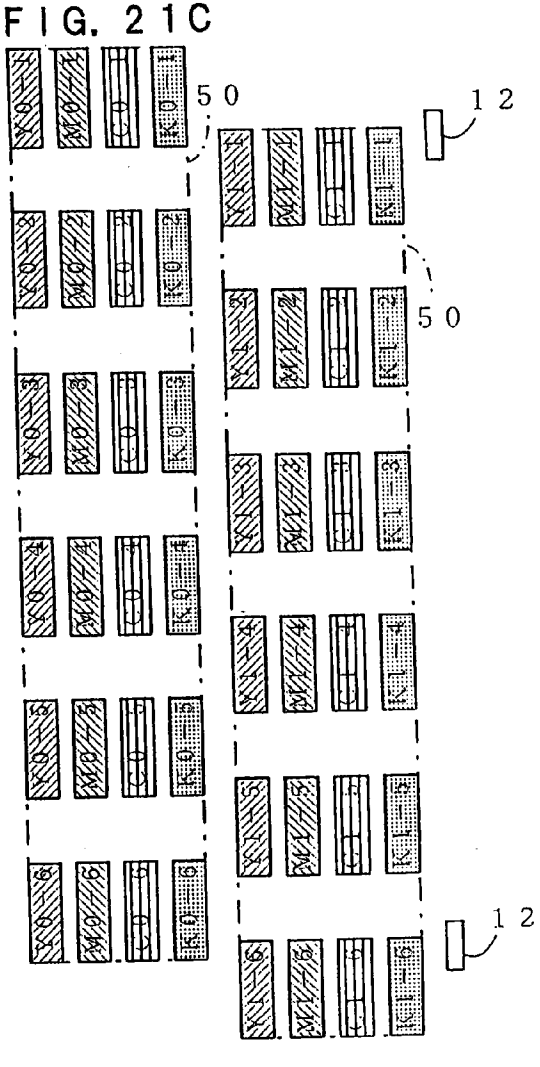
FIGS. 21A through 21C are drawings showing examples in which the unit recording heads are made into a unit.
Figure 21B:
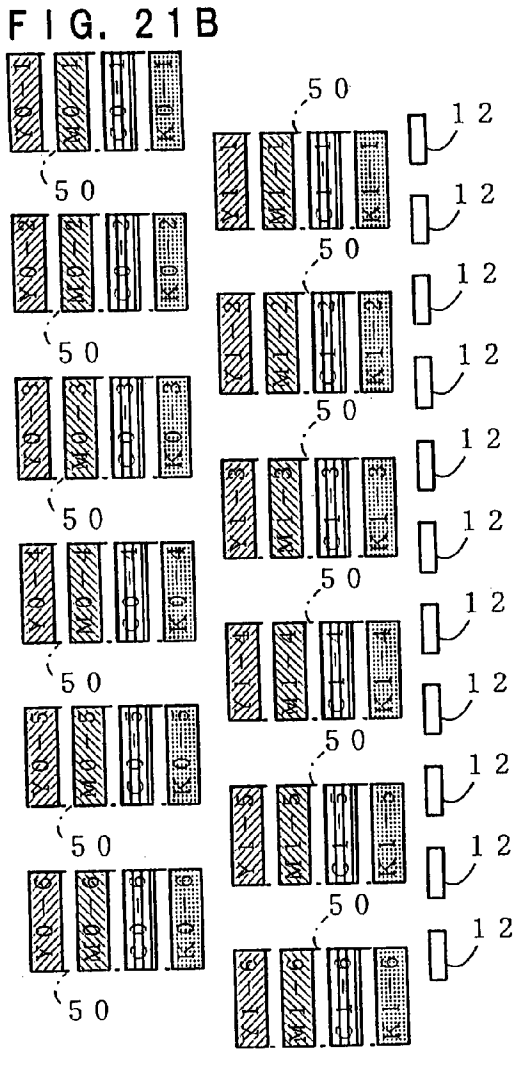
Figure 21A:
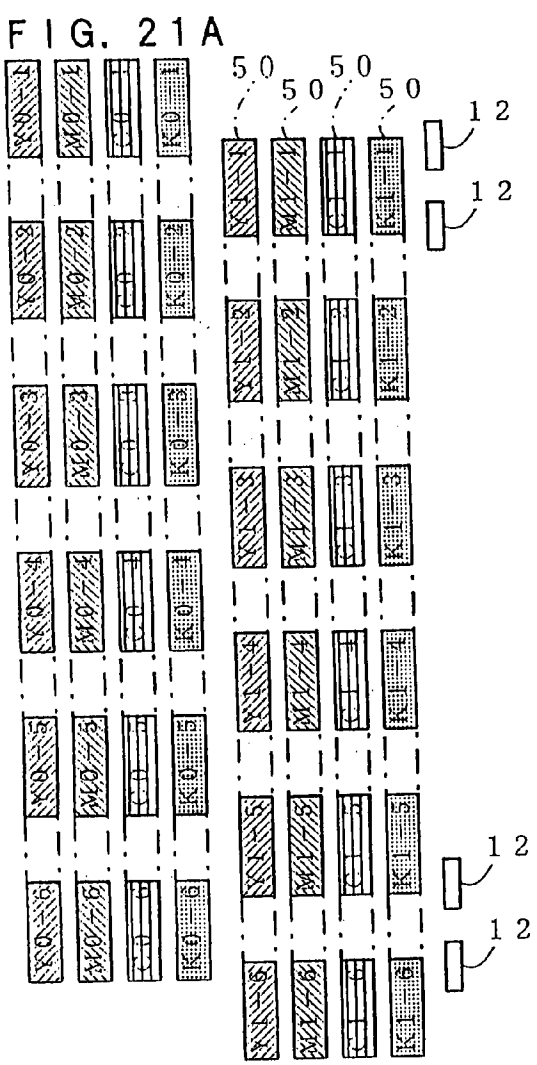

Three examples of forming the unit recording heads as units are shown in FIG. 21. FIG. 21A shows an example in which the unit recording heads in the widthwise direction, i.e., the unit recording heads of the same color, have been formed into units on a column-by-column basis (e.g., the unit recording heads Y0-1 through Y0-6 are formed into a single unit 50). FIG. 21B shows an example in which the unit recording heads are formed into units of each of the four colors (e.g., the unit recording heads Y0-1, M0-1, C0-1, and K0-1 form the single unit 50). FIG. 21C shows an example in which the unit recording heads are made into a unit which includes the widthwise direction columns of the four colors (e.g., the unit recording heads Y0-1 through Y0-6, M0-1 through M0-6, C0-1 through C0-6, and K0-1 through K0-6 are one unit). The arrangements of the sensors 12 for detecting the image positional offsets among the respective units 50 are also shown in these drawings.

In FIG. 21A, in order to detect the offsets among the respective units 50, a total of four of the sensors 12 are disposed at the both ends. Two of the sensors 12 are disposed at each side in order to accurately detect the offset between the units 50, and there are cases in which it is sufficient to provide one sensor 12 at each side. Further, the reason why the sensors 12 are disposed at the both sides is in order to detect the inclined offset (skewing) of each of the units 50. If there is no need to detect the inclined offset for each of these units 50 in this way, it is possible to provide only one of the sensors 12 at the central portion. Further, in FIG. 21B, in order to detect the offsets among the respective units 50, the sensors 12 are disposed between the respective units 50, and the offset per unit 50 can be detected and corrected. Moreover, in FIG. 21C, because the unit recording heads are made into a unit which includes the widthwise direction columns of the four colors, it suffices to provide two of the sensors 12 for detecting the offsets of the respective units.

In the above embodiment, description is given of an example in which correction is carried out by using black as the reference in order to match the other three colors with the black unit recording head 10A. However, for example, the average values of the maximum and the minimum of the three offset amounts of yellow and black, magenta and black, and cyan and black can be made to coincide. In this way, the correction amount is small. For example, there is the advantage that less buffer memory is used at the time of skewing correction.

In the present invention, the correcting section may correct the recording offsets of the respective unit recording heads in the direction orthogonal to the moving direction of the recording medium, or may correct the recording offsets of the respective unit recording heads in the moving direction of the recording medium.

The recording head may include unit recording heads which record images of plural colors.

The correcting section may correct the recording offsets in the direction orthogonal to the moving direction of the recording medium by changing the recording regions of the unit recording heads. The correcting section may correct the recording offsets in the moving direction of the recording medium by changing the recording timings of the unit recording heads.

Further, the correcting section may change the recording timings of the unit recording heads by offsetting the inclining of the image recording positions due to the inclining of the unit recording heads.

When the number of divisions of the recording head in the direction orthogonal to the recording medium moving direction is N, (N−1) detecting sections may be provided. Or, when the number of divisions of the recording head in the direction orthogonal to the recording medium moving direction is N, (N+1) detecting sections may be provided.

In addition, the recording head may be structured by plural units, with each unit being formed by a predetermined number of unit recording heads.

What is claimed is:

1. An image forming apparatus comprising:

a recording head having a plurality of unit recording heads divided in a direction orthogonal to a moving direction of a recording medium;

a detecting section detecting, for every adjacent pair of the unit recording heads in the plurality of unit recording heads, each image recorded by end portions of the unit recording heads facing each other in each pair, the detecting section having a plurality of sensors, each sensor corresponding to an adjacent pair of unit recording heads; and a correcting section correcting a recording offset of the recording head on the basis of results of detection of the detecting section.

2. The image forming apparatus of claim 1, wherein the correcting section corrects recording offset, in the direction orthogonal to the moving direction of the recording medium, of each of the plurality of unit recording heads.

3. The image forming apparatus of claim 2, wherein the correcting section corrects the recording offset in the direction orthogonal to the moving direction of the recording medium, by changing a recording region of each of the plurality of unit recording heads.

4. The image forming apparatus of claim 1, wherein the recording head includes unit recording heads recording images of plural colors.

5. The image forming apparatus of claim 1, wherein the correcting section corrects recording offset, in the moving direction of the recording medium, of each of the plurality of unit recording heads.

6. The image forming apparatus of claim 5, wherein the correcting section corrects the recording offset in the moving direction of the recording medium, by changing a recording timing of each of the plurality of unit recording heads.

7. The image forming apparatus of claim 1, wherein the correcting section changes a recording timing of each of the plurality of unit recording heads, so as to offset inclining of image recording positions caused by inclining of each of the plurality of unit recording heads.

8. The image forming apparatus of claim 7, wherein the correcting section divides a recording region of one unit recording head of the plurality of unit recording heads into plural regions, and changes the recording timings of the plural regions discretely.

9. The image forming apparatus of claim 8, wherein, when the correcting section divides the recording region of the one unit recording head into the plural regions, a number of divisions is determined in accordance with an inclination offset amount of the image recording position.

10. The image forming apparatus of claim 1, wherein, given that a number of divisions of the recording head in the direction orthogonal to the moving direction of the recording medium is N, (N−1) of the detecting sections are provided.

11. The image forming apparatus of claim 1, wherein, given that a number of divisions of the recording head in the direction orthogonal to the moving direction of the recording medium is N, (N+1) of the detecting sections are provided.

12. The image forming apparatus of claim 1, wherein the recording head is structured by a plurality of units, with one unit being a predetermined number of the unit recording heads among the plurality of unit recording heads.

13. The image forming apparatus of claim 1, wherein each of the plurality of unit recording heads has a plurality of nozzles which discharge ink.

14. The image forming apparatus of claim 1, wherein the plurality of unit recording heads are disposed substantially along an entire width in the direction orthogonal to the moving direction of the recording medium, and are in staggered rows which are disposed so as to be offset in both the moving direction of the recording medium and the direction orthogonal to the moving direction of the recording medium.

15. The image forming apparatus of claim 14, wherein adjacent unit recording heads among the plurality of unit recording heads have regions which overlap in the direction orthogonal to the moving direction of the recording medium.

16. The image forming apparatus of claim 15, wherein the detecting section is provided at a position of detecting an image recorded by portions of the unit recording heads corresponding to the regions which overlap.

17. The image forming apparatus of claim 1, wherein the detecting section includes a CCD sensor.

18. The image forming apparatus of claim 1, wherein a predetermined test pattern is recorded on the recording medium, the predetermined test pattern is detected by the detecting section, and the correcting section corrects the recording offset of the recording head on the basis of the results of detection of the detecting section.

19. The image forming apparatus of claim 18, wherein the predetermined test pattern is recorded at predetermined intervals at positions corresponding to junctures of recording positions of adjacent recording heads among the plurality of unit recording heads.

20. The image forming apparatus of claim 1, wherein the detecting section is substantially shaped as a bar which extends in the direction orthogonal to the moving direction of the recording medium, and is longer than a width of the recording medium in the direction orthogonal to the moving direction of the recording medium.

21. An image forming apparatus comprising:

a recording head having a plurality of unit recording heads divided in a direction orthogonal to a moving direction of a recording medium;

a detecting section detecting, for every adjacent pair of the unit recording heads in the plurality of unit recording heads, each image recorded by end portions of the unit recording heads facing each other in each pair, the detecting section having a plurality of sensors, each sensor corresponding to an adjacent pair of unit recording heads; and a correcting section correcting a recording offset of the recording head on the basis of results of detection of the detecting section, wherein the recording head has a plurality of blocks, with each block being structured by a predetermined number of the unit recording heads, which can record images of plural colors and which are lined-up along the moving direction of the recording medium, and the plurality of blocks are lined-up in a staggered form along the direction orthogonal to the moving direction of the recording medium.

22. The image forming apparatus of claim 21, wherein the correcting section corrects recording offset, in the direction orthogonal to the moving direction of the recording medium, of each of the plurality of unit recording heads, and corrects recording offset, in the moving direction of the recording medium, of each of the plurality of unit recording heads.

* * * * *